US007604573B2

(12) United States Patent
Dalebout et al.

(10) Patent No.: US 7,604,573 B2
(45) Date of Patent: Oct. 20, 2009

(54) METHOD AND SYSTEM FOR VARYING STRIDE IN AN ELLIPTICAL EXERCISE MACHINE

(75) Inventors: William T. Dalebout, North Logan, UT (US); N. Jeffrey Chatterton, Logan, UT (US); Jaremy T. Butler, Paradise, UT (US); D. Jeffrey Nielsen, Nibley, UT (US); Gaylen W. Ercanbrack, Logan, UT (US)

(73) Assignee: Icon IP, Inc., Logan, UT (US)

( * ) Notice: Subject to any disclaimer, the term of this patent is extended or adjusted under 35 U.S.C. 154(b) by 371 days.

(21) Appl. No.: 11/107,375

(22) Filed: Apr. 14, 2005

(65) Prior Publication Data

US 2006/0234838 A1 Oct. 19, 2006

(51) Int. Cl.
*A63B 22/04* (2006.01)

(52) U.S. Cl. ..... 482/52

(58) Field of Classification Search ..... 482/51–53, 482/57, 62, 70, 71, 139; *A63B 22/04*
See application file for complete search history.

(56) References Cited

U.S. PATENT DOCUMENTS 4,509,742 A * 4/1985 Cones ..... 482/58
5,383,829 A 1/1995 Miller
5,529,555 A * 6/1996 Rodgers, Jr. ..... 482/57
5,611,756 A 3/1997 Miller
5,743,834 A 4/1998 Rodgers, Jr.
5,759,136 A * 6/1998 Chen ..... 482/57
5,921,894 A 7/1999 Eschenbach
5,993,359 A 11/1999 Eschenbach
6,024,676 A 2/2000 Eschenbach
6,027,431 A 2/2000 Stearns et al.
6,030,320 A 2/2000 Stearns et al.
6,042,512 A 3/2000 Eschenbach
6,045,487 A 4/2000 Miller
6,045,488 A 4/2000 Eschenbach
6,053,847 A * 4/2000 Stearns et al. ..... 482/51
6,077,196 A 6/2000 Eschenbach
6,077,198 A 6/2000 Eschenbach (Continued)

OTHER PUBLICATIONS

Life Fitness: X5, internet website, http://us.home.lifefitness.com/content.cfm/x5?pff=1, Mar. 22, 2005, pp. 1-3, US.

*Primary Examiner*—Loan H Thanh
*Assistant Examiner*—Oren Ginsberg
(74) *Attorney, Agent, or Firm*—Workman Nydegger

(57) ABSTRACT

Disclosed is an exercise machine, and particularly a front or rear mount elliptical or elliptical-type machine, comprising: (a) a support structure; (b) a drive component pivotally coupled to the support structure and configured to rotate about a first pivot axis; (c) a reciprocating foot support configured to travel about a closed path having a stride length upon rotation of the drive component; (d) a coupling configuration configured to support the reciprocating foot support about the drive component at a position radially offset from the first pivot axis, the coupling configuration pivotally coupled to the drive component about a second pivot axis; and (e) an adjustment mechanism configured to enable the coupling configuration to pivot about the second pivot axis between at least two adjustment positions to vary the radial offset of the reciprocating foot support with respect to the first pivot axis.

37 Claims, 13 Drawing Sheets

U.S. PATENT DOCUMENTS 6,090,013 A 7/2000 Eschenbach
6,090,014 A 7/2000 Eschenbach
6,113,518 A * 9/2000 Maresh et al. ..... 482/52
6,168,552 B1 1/2001 Eschenbach
6,210,305 B1 4/2001 Eschenbach
6,338,698 B1 1/2002 Stearns et al.
6,361,476 B1 3/2002 Eschenbach
6,436,007 B1 8/2002 Eschenbach
6,440,042 B2 8/2002 Eschenbach
6,450,925 B1 9/2002 Kuo
6,569,061 B2 * 5/2003 Stearns et al. ..... 482/52
6,620,079 B2 9/2003 Kuo
6,689,019 B2 2/2004 Ohrt et al.
6,689,020 B2 2/2004 Stearns et al.
6,726,600 B2 4/2004 Miller
6,786,669 B2 * 9/2004 Tsui et al. ..... 403/322.2
6,895,834 B1 * 5/2005 Baatz ..... 74/594.3
7,226,394 B2 * 6/2007 Johnson ..... 482/57
7,252,627 B2 * 8/2007 Carter ..... 482/98
2001/0036886 A1 11/2001 Eschenbach
2002/0019298 A1 2/2002 Eschenbach
2002/0077220 A1 6/2002 Kuo
2002/0142890 A1 10/2002 Ohrt et al.
2002/0198083 A1 12/2002 Goh
2002/0198084 A1 12/2002 Stearns et al.
2003/0027690 A1 2/2003 Miller
2004/0097339 A1 5/2004 Moon
2004/0132583 A1 7/2004 Ohrt et al.
2004/0180760 A1 9/2004 Rufino
2004/0248704 A1 12/2004 Rodgers, Jr.
2004/0248705 A1 12/2004 Rodgers, Jr.
2004/0248706 A1 12/2004 Rodgers, Jr.
2004/0248707 A1 12/2004 Rogers
2004/0248708 A1 12/2004 Rodgers, Jr.
2004/0248709 A1 12/2004 Rodgers, Jr.
2004/0248710 A1 12/2004 Rodgers, Jr.
2004/0248711 A1 12/2004 Rodgers, Jr.
2005/0049117 A1 3/2005 Rodgers, Jr.
2006/0019802 A1 * 1/2006 Caird ..... 482/57
2006/0079381 A1 * 4/2006 Cornejo et al. ..... 482/52
2006/0166791 A1 * 7/2006 Liao et al. ..... 482/52
2007/0249471 A1 * 10/2007 Nurre ..... 482/57

* cited by examiner

METHOD AND SYSTEM FOR VARYING STRIDE IN AN ELLIPTICAL EXERCISE MACHINE

FIELD OF THE INVENTION

The present invention relates generally to exercise equipment or exercise machines. More particularly, the present invention relates to elliptical or elliptical-type exercise machines and a method and system for varying or adjusting the stride of the reciprocating foot supports supported on an elliptical exercise machine for one or more purposes, and namely to accommodate different exercise routines and different users.

BACKGROUND OF THE INVENTION AND RELATED ART

Exercise machines having alternating reciprocating foot supports configured to traverse or travel about a closed path to simulate a striding, running, walking, and/or a climbing motion for the individual using the machine are well known in the art, and are commonly referred to as elliptical exercise machines or elliptical cross-trainers. In general, an elliptical or elliptical-type exercise machine comprises a pair of reciprocating foot supports designed to receive and support the feet of a user. Each reciprocating foot support has at least one end supported for rotational motion about a pivot point or pivot axis, with the other end supported in a manner configured to cause the reciprocating foot support to travel or traverse a closed path, such as a reciprocating elliptical or oblong path or other similar geometric outline. Therefore, upon operation of the exercise machine to rotate the proximal end, each reciprocating foot support is caused to travel or traverse the closed path. The reciprocating foot supports are configured to be out of phase with one another by 180° in order to simulate a proper and natural alternating stride motion.

An individual may utilize an elliptical or elliptical-type exercise machine by placing his or her feet onto the reciprocating foot supports. The individual may then actuate the exercise machine for any desired length of time to cause the reciprocating foot supports to repeatedly travel their respective closed paths, which action effectively results in a series of strides achieved by the individual to obtain exercise, with a low-impact advantage. An elliptical or elliptical-type machine may further comprise mechanisms or systems for increasing the resistance of the motion, and/or for varying the vertical elevation or height of the closed path. In addition, the reciprocating motion of the feet to achieve a series of strides may be complemented by a reciprocating movement of the arms, whether assisted by the exercise machine via a suitably configured mechanism or system, or unassisted.

A typical closed path may comprise a generally horizontal outline having a longitudinal axis therethrough. Depending upon the exercise machine, a closed path may be many different sizes. As such, a particular measurement of interest to individuals with respect to an elliptical or elliptical-type exercise machine is "stride length." A stride length is essentially a measurement of the distance separating the two furthest points along the longitudinal axis of the closed path. Therefore, upon actuation of the exercise machine, a single stride may be referred to as travel by the reciprocating foot support, and therefore the foot of a user, along the closed path front a first endpoint on the longitudinal axis of the closed path to a distal distant endpoint, also on the longitudinal axis. The stride anti resulting stride length provided by an exorcise machine, although simulated and possibly modified, is comparable to a single stride achieved during natural and/or modified gait of an individual.

Obviously, the strides, and particularly the stride lengths, between different individuals may vary, perhaps considerably. Indeed, a person of small stature will most likely have a much shorter stride length than a person of large stature, and thus will be more comfortable on an exercise machine configured to accommodate his or her particular size and resulting stride length. As such, it is important that the exercise machine function with a stride that corresponds to the stride of the user. The challenge arises when the exercise machine is intended for use by many individuals that may or may not have the same stride length. Moreover, it may be desirable within an exercise routine to vary the speed or frequency of strides along the closed path, the resistance felt, and/or the vertical height of the closed path, wherein some or all of these variable elements may require the user to adapt his or her stride to the changing routine to realize a more natural motion.

Despite their many advantages, and despite recent efforts to attain such, elliptical or elliptical-type exercise machines are devoid of a simple and efficient way to vary their stride length for the purpose of accommodating the stride lengths of individuals of different size and of providing a more natural stride motion. Many prior related exercise machines exist in the art that comprise complex or intricate solutions. However, many of these are difficult to operate at best, and are also expensive to manufacture and cumbersome to assemble as many of them comprise several components or linkages to ultimately achieve a variable stride length.

Another inherent deficiency with the many prior related exercise machines comprising a mechanism or system for varying the stride length of the machine is that they are so complex in design that it would be difficult to utilize the system or mechanism technology on different machines without requiring significant modifications to the machine, if possible at all.

SUMMARY OF THE INVENTION

In light of the problems and deficiencies inherent in the prior art, the present invention seeks to overcome these by providing an exercise machine having the ability to be selectively adjusted to vary the stride of alternating reciprocating foot supports supported, and therefore the stride or stride length of a user.

As broadly embodied and described herein, the present invention features an exercise machine comprising: (a) a support structure; (b) a drive component pivotally coupled to the support structure and configured to rotate about a first pivot axis; (c) a reciprocating foot support configured to travel about a closed path having a stride length upon rotation of the drive component; (d) a coupling configuration configured to support the reciprocating foot support about the drive component at a position radially offset from the first pivot axis, the coupling configuration pivotally coupled to the drive component about a second pivot axis; and (e) an adjustment mechanism configured to enable the coupling configuration to pivot about the second pivot axis between at least two adjustment positions to vary the radial offset of the reciprocating foot support with respect to the first pivot axis.

In some embodiments, the reciprocating foot supports are further supported at a position offset from a longitudinal axis of the drive component. In other embodiments, the reciprocating foot supports are further supported at a position along the longitudinal axis of the drive component.

Moreover, in some embodiments, the reciprocating foot support comprises an axis of rotation that allows the reciprocating foot support to properly orbit the drive component during its rotation.

The drive component may comprise a crank, a wheel, or any other structure configured to rotate about a pivot point in a concentric or eccentric manner.

In one exemplary embodiment, the coupling configuration comprises a link having a proximal end pivotally coupled to the drive component, the link being configured to rotate about a second pivot axis positioned offset from the first pivot axis; and a strut extending from a distal end of the link and configured to couple the reciprocating foot support, the strut being radially offset from the first pivot axis and providing an axis of rotation for the reciprocating foot support.

In an exemplary embodiment, the adjustment mechanism comprises a plurality of adjustment apertures formed within the drive component, each of the adjustment apertures being configured to vary the stride length of the reciprocating foot support; a pin contained within the strut and configured to releasably and selectively engage the adjustment apertures upon rotation of the link about the second pivot axis to vary the stride length of the reciprocating foot support; and biasing means configured to bias the pin within the strut.

The present invention also features an exercise machine comprising: (a) a support structure; (b) a drive component pivotally coupled to the support structure and configured to rotate about a first pivot axis; (c) a reciprocating foot support configured to travel about a closed path having a stride length upon rotation of the drive component; and (d) a rotatable engagement member supported within the reciprocating foot support and configured to couple the reciprocating foot support to the drive component at a position radially offset from the first pivot axis, the rotatable engagement member configured to adjust between at least two adjustment positions with respect to the first pivot axis to vary the radial offset of the reciprocating foot support with respect to the first pivot axis to vary the stride length.

The present invention further features an exercise machine comprising: (a) a support structure; (b) a crank having a proximal end pivotally coupled to the support structure and configured to rotate about a first pivot axis; (c) a strut pivotally coupled to the crank at a position radially offset from the first pivot axis, the strut configured to define and travel about a radial path upon rotation of the crank; (d) a reciprocating foot support having a proximal end coupled to the strut and a supported distal end, the reciprocating foot support configured to rotate about the strut and to traverse a closed path having a stride length upon rotation of the crank; and (e) an adjustment mechanism configured to selectively position the strut between at least two adjustment positions to vary the radial offset position of the strut and the reciprocating foot support with respect to the first pivot axis to vary the stride length.

In still another broad sense, the present invention still further features an exercise machine comprising: (a) means for supporting a drive component about a surface, the drive component configured to rotate about a first pivot axis; (b) means for coupling a reciprocating foot support to the drive component at a position radially offset from the first pivot axis, the reciprocating foot support traversing a closed path having a stride length defined by a relative distance between the reciprocating foot support and the first pivot axis; and (c) means for pivoting the means for coupling between at least two adjustment positions to vary the offset position of the reciprocating foot support with respect to the first pivot axis to vary the stride length.

In a more specific description, the present invention features an elliptical exercise machine comprising: (a) a support structure; (b) a crank having a proximal end pivotally coupled to the support structure and configured to rotate about a first pivot axis, the crank comprising a plurality of adjustment apertures formed therein, each being radially offset from the first pivot axis and each defining an adjustment position; (c) a link having a proximal end pivotally coupled to a distal end of the crank, the link configured to rotate about a second pivot axis positioned offset from the first pivot axis; (d) a strut extending from a distal end of the link and configured to provide an axis of rotation radially offset from the first pivot axis, the strut configured to define and travel about a radial path upon rotation of the crank; (e) a reciprocating foot support having a proximal end coupled to the strut and a supported distal end, the reciprocating foot support configured to traverse a closed path having a stride length defined by the radial path; and (f) a pin contained within the strut and configured to selectively engage the adjustment apertures upon rotation of the link to vary the radial offset position of the axis of rotation to vary the stride length of the reciprocating foot support.

Finally, the present invention still further features a method for varying the stride of an exercise machine comprising: (a) providing a coupling configuration configured to couple a reciprocating foot support to a crank at a position radially offset from a first pivot axis; (b) operating the exercise machine to cause the reciprocating foot support to define a radial path about the first pivot axis upon rotation of the crank, and to cause the reciprocating foot support to traverse a closed path having a stride length; (c) causing the coupling configuration to pivot between at least two adjustment positions to adjust the radial offset of the reciprocating foot support with respect to the first pivot axis for the purpose of varying the stride length of the reciprocating foot support.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

FIG. 10-B illustrates a side view of the reciprocating foot support depicted in FIG. 10-A;

DETAILED DESCRIPTION OF EXEMPLARY EMBODIMENTS

Figure 1:
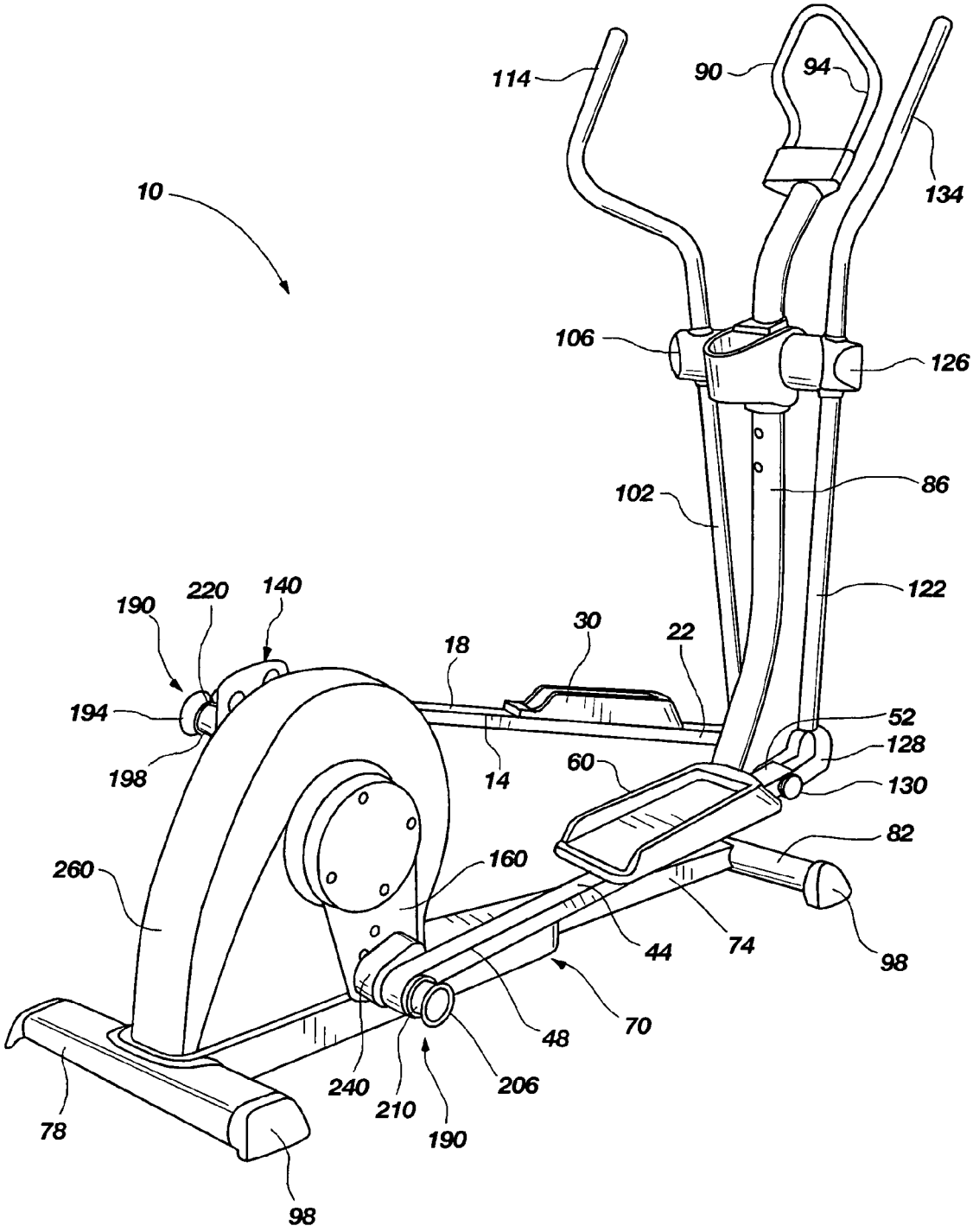
FIG. 1 illustrates a perspective view of a rear mount or rear mechanism-type exercise machine according to one exemplary embodiment of the present invention.

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention, as represented in FIGS. 1 through 14, is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

The present invention describes a method and system for varying the stride length of an exercise machine whose components are configured to travel about a closed path, such as an elliptical or elliptical-type exercise machine. Generally, the present invention describes a simple and efficient way to vary the stride length of the exercise machine to accommodate the different strides and resulting stride lengths of different users, as well as to improve the natural motion of the desired type of stride, whether that be walking, running, climbing, or any combination of these.

At the outset, although many of the principles, exercise machines, systems, devices, assemblies, mechanisms, and methods described herein are discussed primarily in terms of their use with those types of elliptical exercise machines having a rear mount drive component or crank that utilizes swing arms, one ordinarily skilled in the art will understand that such principles, exercise machines, systems, devices, assemblies, mechanisms, and methods are adaptable, without undue experimentation, to be useable on an elliptical exercise machine or other similar type of exercise machine having a front mount configuration, wherein the closed path is generated by a front mount drive component, such as on a front mechanical-type exercise machine, or through any other manner, and are similarly adaptable for use on those types of exercise machines having stationary or fixed hand grips or handlebars.

The present invention provides several significant advantages over many prior related exercise machines comprising a system or mechanism for varying stride length within a closed path. First, an adjustment mechanism or system that adjusts the relative position of the reciprocating foot support with respect to the pivot point of the drive component provides a simple and effective solution to stride length variability that may be easily incorporated into several exercise machine designs. Second, by providing an adjustment mechanism configured to pivot about a central axle or pivot point located on the drive component or the crank and to engage one of a plurality of adjustment apertures formed in the drive component or crank, the ease and efficiency of adjustment of the stride length is improved because there are no parts that are releasable from the crank. In other words, everything is contained within the mechanism. Third, the support structure, such as a base or frame support, can be configured to comprise a much smaller foot print, thus changing the foot pad location along the reciprocating foot support. Fourth, the adjustment system or mechanism can be incorporated into a front mount (front mechanical-type) or rear mount (rear mechanical-type) exercise machine, as commonly known in the art. Fourth, different individuals with different strides or stride lengths can use the same machine at the same level of comfort, meaning the same natural simulated stride may be achieved for different individuals.

Each of the above-recited advantages will be apparent in light of the detailed description set forth below, with reference to the accompanying drawings. These advantages are not meant to be limiting in any way. Indeed, one skilled in the art will appreciate that other advantages may be realized, other than those specifically recited herein, upon practicing the present invention.

With reference to FIG. 1, illustrated is a perspective view of a rear mount or rear mechanical-type elliptical exercise machine according to one exemplary embodiment of the present invention. Specifically, FIG. 1 illustrates the elliptical exercise machine 10 as comprising a first reciprocating foot support 14 having a first end 18, a second end 22, and a corresponding foot pad 30 provided thereon and located between the first end 18 and the second end 22. Complementing the first reciprocating foot support 14 is a second reciprocating foot support 44 having a first end 48, a second end 52, and a corresponding foot pad 60 provided thereon and located between the first end 48 and the second end 52. The first and second reciprocating foot supports 14 and 44 are laterally spaced apart from one another, such that each of the corresponding foot pads 30 and 60, respectively, are capable of comfortably receiving a respective foot of a user and for facilitating the performance of a striding motion with the user facing in the forward direction. It is noted herein, that the foot pads 30 and 60 are provided on the reciprocating foot supports 14 and 44, respectively, and that each of the foot pads 30 and 60 is sized and configured to receive the foot of a user. It is also noted that the reciprocating foot supports 14 and 44 may be alternatively configured without foot pads, with the user standing directly on the upper surface of the reciprocating foot supports 14 and 44. In this embodiment, a non-slip material may be added to the surface of the reciprocating foot supports.

The reciprocating foot supports 14 and 44, as well as the other components of the exercise machine, are supported by a support structure 70. The support structure 70 is configured to provide both structural and translational support to the components of the exercise machine 10, and also to interface with the ground. The support structure 70 generally defines the size of the foot print of the exercise machine 10. The support structure 70 may be any suitable frame-like structure or other configuration. In addition, the support structure 70 may comprise a unitary structure, or a plurality of components all coupled together or in groups. Essentially, the support structure 70 may comprise any suitable design and is not limited in any way herein. In the embodiment shown, the support structure 70 comprises an I-beam base configuration having a longitudinal support beam 74 functioning as the primary support member, and first and second lateral cross beams 78 and 82 located about and extending in opposing directions from each end of the longitudinal support beam 74. Rubber or plastic caps 98 may be situated on the ends of the cross beams 78 and 82. Extending upward from the longitudinal support beam 74 is a vertical or upright support 86 that functions to assist in the support of first and second swing arms 102 and 122. The vertical support 86 may comprise or support various known items or assemblies, such as a user interface, fixed handle bars, cup holders, magazine or book racks, etc. In the embodiment shown, first and second fixed handle bars 90 and 94 are supported atop the vertical support 86.

Each of the second ends 22 and 52 of the first and second reciprocating foot supports 14 and 44 may be supported in any way commonly known in the art to enable the operation of the exercise machine 10, and particularly the reciprocating motion of the reciprocating foot supports 14 and 44. In one exemplary embodiment, the first and second ends 22 and 52 of the first and second reciprocating foot supports 14 and 44 may be pivotally coupled to first and second swing arms, respectively, such as illustrated in FIG. 1. In another exemplary embodiment, the first and second ends 22 and 52 may comprise rollers, respectively, that glide along a track.

As shown in FIG. 1, the first and second reciprocating foot supports 14 and 44 have their second ends 22 and 52 pivotally coupled to first and second swing arms 102 and 122, respectively. The first swing arm 102 is pivotally coupled to the vertical support 86 about a pivot axis 106 using any known coupling means. The second swing arm 122 is likewise pivotally coupled to the vertical support 86 about a pivot axis 126 using any known coupling means. The first and second swing arms 102 and 122 are configured to be laterally spaced apart on opposing left and right sides of the vertical support 86. The first and second swing arms 102 and 122 are elongate links having upper and lower ends. The upper ends are pivotally coupled to the vertical support 86 and configured to pivot about pivot points 106 and 126, respectively, while the lower ends are each pivotally coupled to the first and second reciprocating foot supports 14 and 44 and are configured to pivot about pivot points 110 and 130, respectively. The swing arms 102 and 122 function to guide the second ends 22 and 52 of the first and second reciprocating foot supports 14 and 44, respectively, in a pendulous reciprocating motion along an arcuate closed path upon operation of the exercise machine 10. Travel about this arcuate closed path provides a substantially horizontal forward-rearward component of motion that effectively simulates a user's stride. Due to the coupling configuration of the reciprocating foot supports 14 and 44 at each of their ends, the closed path traveled by the foot pads 30 and 60 is generally elliptical in nature, with the majority of the path comprising a horizontal component, although a vertical component is also present.

The exercise machine 10 further comprises first and second drive components, shown as first and second cranks or crank arms 140 and 160 rotatably supported about the support structure 70 using any known means for supporting. It is contemplated that the present invention may be incorporated into any type of drive component capable of rotating about a pivot point in either a concentric or eccentric manner. However, for the purposes of discussion, the drive component will be described as a crank. The cranks 140 and 160 are preferably in a fixed relationship with respect to one another and are configured to travel along identical repeating circular paths about respective pivot points (see FIG. 2). The first and second cranks 140 and 160 are also configured to be out of phase with one another by 180° in order to facilitate an alternating reciprocating motion within the first and second reciprocating foot supports 14 and 44 and to simulate the natural alternating strides of a user. Each of the cranks preferably comprise a fixed or non-adjustable size or length. In addition, each of the cranks preferably comprise a relatively wide configuration to accommodate the various and adjustable coupling positions of the reciprocating foot supports. In the embodiment shown, the length to width ratio of the crank is about 2:1.

The present invention exercise machine 10 further comprises means for coupling the reciprocating foot supports to the drive components, respectively. The means for coupling is intended to couple each of the reciprocating foot supports to the respective drive components at a position that is radially offset from the pivot points of the drive components, thus allowing each of the reciprocating foot supports to traverse or travel about a closed path, wherein the closed path comprises a stride length. The stride length is dictated, at least in part, by the relative distance between the reciprocating foot supports and the pivot points of the cranks. The first ends 18 and 48 of the first and second reciprocating foot supports 14 and 44 are rotatably supported about a distal or free end of the corresponding cranks 140 and 160 by a suitable coupling configuration. As so supported, the reciprocating foot supports 14 and 44 are allowed to move rearward and forward along a closed path during operation of the exercise machine 10.

Means for coupling the reciprocating foot supports to the respective drive components may comprise a number of different coupling configurations, several of which are illustrated in the drawings and described herein. Generally, as shown in FIG. 1, one exemplary means for coupling comprises a coupling configuration 190 having first and second struts 194 and 206 coupled to and extending orthogonally outward from the cranks 140 and 160, respectively. In some embodiments, the struts 194 and 206 may be coupled directly to the cranks 140 and 160. However, in the embodiment shown in FIG. 1, the coupling configuration further comprises first and second links 220 and 240 rotatably coupled to the cranks 140 and 160, wherein the struts 194 and 206 extend therefrom and are coupled thereto. The links 220 and 240 are provided as part of an adjustment system or assembly or mechanism discussed in greater detail below. The adjustment system or mechanism is a manual adjustment system. However, it is contemplated that adjusting the reciprocating foot supports 14 and 44 with respect to the pivot point of the crank, as discussed below, may be done electronically or automatically.

Each of the first and second struts 194 and 206 further comprise relating collars 198 and 210, respectively, configured to rotatably receive and couple the first ends 18 and 48 of the first anti second reciprocating foot supports 14 and 44, respectively. The rotatable collars 198 and 210 allow the first and second reciprocating fool supports 14 and 44 to rotate about an axis of rotation as coupled to the struts 194 and 206, wherein the axis of rotation is offset from the pivot points of the cranks 140 and 160. Thus as the exercise machine 10 is operated and the first and second cranks 140 and 160 rotate along their respective circular paths, the offset position of the axes of rotation of the reciprocating foot supports 14 and 44, as provided by the struts 190 and 206, with respect to the pivot point of the cranks 14 and 44, as well as the suitably supported second ends 22 and 52 of the reciprocating foot supports 14 and 44, causes the reciprocating root supports 14 and 44 to traverse an elliptical closed path.

FIG. 1 further illustrates a housing 260 configured to enclose the various internal components of the exercise machine 10, such as the crank assembly, any braking or transmission components, etc., as commonly known in the art.

The exercise machine 10 may be operated by placing the feet of the user in the respective foot pads 30 and 60 about the respective reciprocating foot supports 14 and 44. The rotational position of the cranks 140 and 160, and the resulting position of the reciprocating foot supports 14 and 44 about the reciprocating foot path are not important as the exercise machine may be started with these components in any position. To perform an exercising motion and to cause the reciprocating foot supports 14 and 44 to traverse the closed path, the user initiates a striding action, which functions to induce a force upon the reciprocating foot supports 14 and 44 to move them in a forward or backward direction, depending upon their initial starting position. Once a single stride has been completed, each reciprocating foot support changes direction to complete a stride in the opposite direction. Essentially, as one reciprocating foot support is moved forward, the other reciprocating foot support is moved backward under a combination of forces resulting from the fixed coupled relationship of the first and second cranks 140 and 160, which causes a force to be applied to each reciprocating foot support from the opposite reciprocating foot support, from the swing arms 102 and 122 tending to apply a compression or tensile force to each of the reciprocating foot supports 14 and 22, respectively, and from the feet of the user applying a force on the reciprocating foot supports 14 and 18. For example, with the exercise machine 10 in the position illustrated in FIG. 1, the user's gravitational mass, i.e., weight, placed predominantly on the first pad 30 of the first reciprocating foot support 14 causes the first crank 140 to rotate downward, thus causing the reciprocating foot support 14 to move down and forward (during the first quarter of rotation of the crank 140) and down and rearward (during the second quarter or one-half of rotation of the crank 140). The gravitational force resulting from the user's weight being predominantly on the first reciprocating foot support 14 is transmitted to the first crank 140, thus causing the first crank 140 to rotate in the clockwise direction (as viewed from the right side of the exercise machine 10) about its pivot point 110. Conversely, the second reciprocating foot support 44 is being moved upward and backward and upward and forward as the crank 160 travels through one-half of its a rotation, with the second crank 160 functioning in a similar manner. The striding action performed by the user may be repeated as often as desired to achieve a series of strides for exercise. The alternating reciprocating motion of these two reciprocating foot supports provides a simulation of a more natural striding motion that the user might undertake. Indeed, the alternating reciprocating motion allows the user achieve a series of strides, much the same way one would during normal or modified gait.

Figure 2:
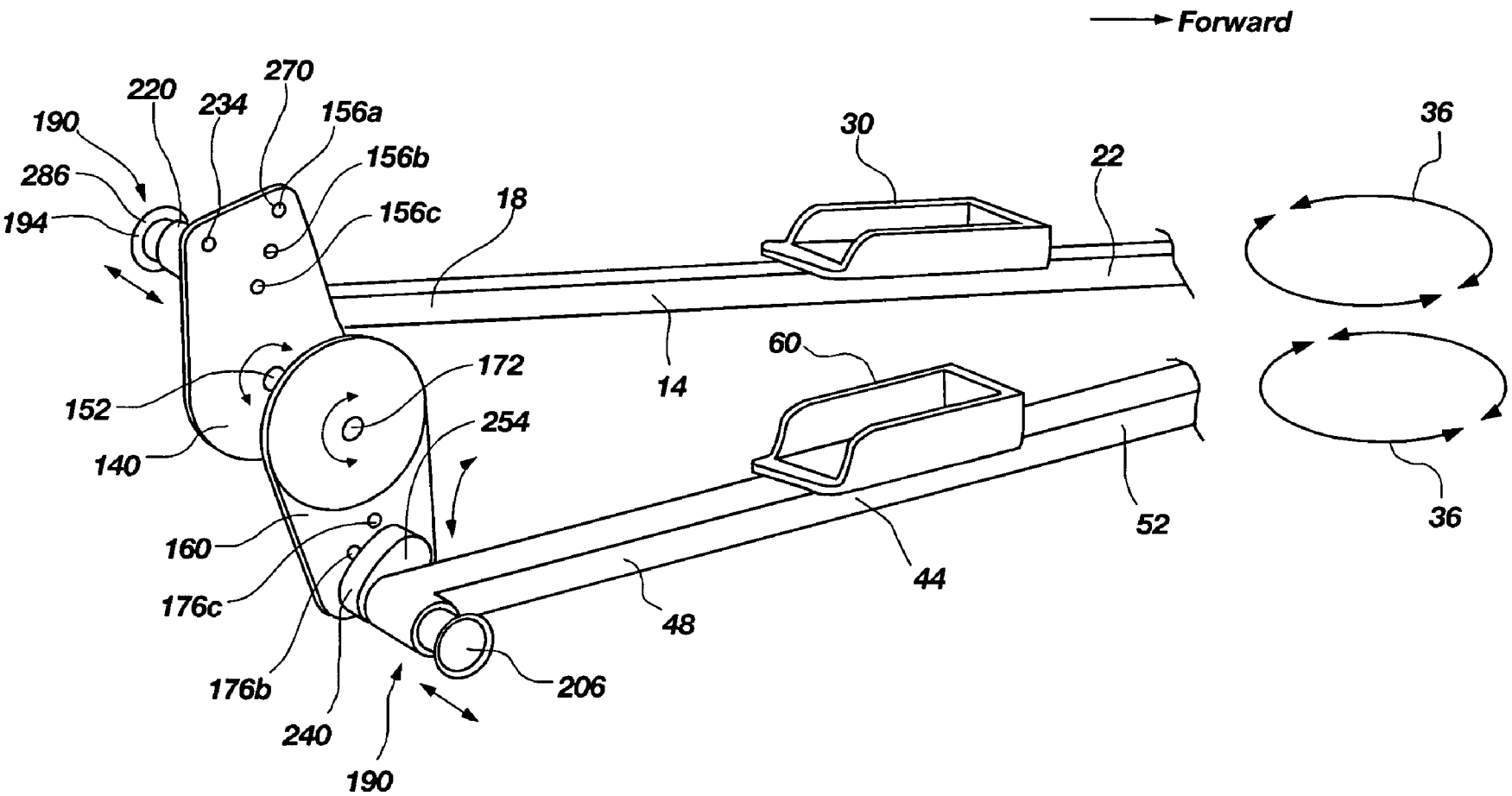
FIG. 2 a general perspective view of the rear mount assembly depicted in FIG. 1, wherein the rear mount system incorporates an exemplary system or mechanism for adjusting the stride of the reciprocating foot supports

With reference to FIGS. 1 and 2, the present invention further features or comprises means for varying the above discussed radial offset position of each of the first and second reciprocating foot supports with respect to the pivot points of the drive components for the specific purpose of varying the stride length realized during operation of the exercise machine 10. Means for varying can comprise a number of assemblies, configurations, and/or mechanisms, each designed to selectively adjust the radial offset position of the reciprocating foot supports with respect to the pivot points of the respective drive components coupling the reciprocating foot supports. Preferably, several adjustment positions will be available, although a minimum of two is necessary to provide for at least two different stride lengths.

FIG. 2 illustrates a simplified drawing of first and second reciprocating foot supports 14 and 44 as attached to the distal ends of first and second cranks 140 and 160 configured to rotate about first pivot axis 152 and 172, respectively, thereby inducing a closed path 36 in each of the reciprocating foot supports 14 and 44. FIG. 2 further illustrates an exemplary coupling configuration 190 operable with an exemplary adjustment mechanism. As shown, the coupling configuration 190 is similar to the one described above and shown in FIG. 1 in that it comprises first and second rotatable struts 194 and 206 extending from rotatable links 220 and 240, with each being configured to rotatably couple the first and second reciprocating foot supports 14 and 44 about an axis of rotation, respectively. Each axis of rotation is shown as being concentric with the struts 194 and 206.

The adjustment mechanisms for adjusting the stride length of the first and second reciprocating foot support 14 and 44 will most likely be the same. In the embodiment shown in FIGS. 1 and 2, and with reference to the first reciprocating foot support 14 and its coupling configuration and adjustment mechanism, the adjustment mechanism comprises a boss or pin 270 (only an end portion being shown as engaged with adjustment aperture 156-*a*) contained and supported within the strut 194 rotatably supported by the link 220, wherein the boss or pin 270 is configured to selectively and releasably engage any one of a plurality of adjustment apertures 156-*a*, 156-*b*, or 156-*c* formed in the first crank 140. The pin 270 is slidably contained within the strut 140 so as to be able to release from one adjustment aperture for insertion into another adjustment aperture. Once inserted into a selected adjustment aperture, the pin functions to temporarily fix the coupling arrangement and related position of the reciprocating foot support 14 about the crank 140.

Figure 8:
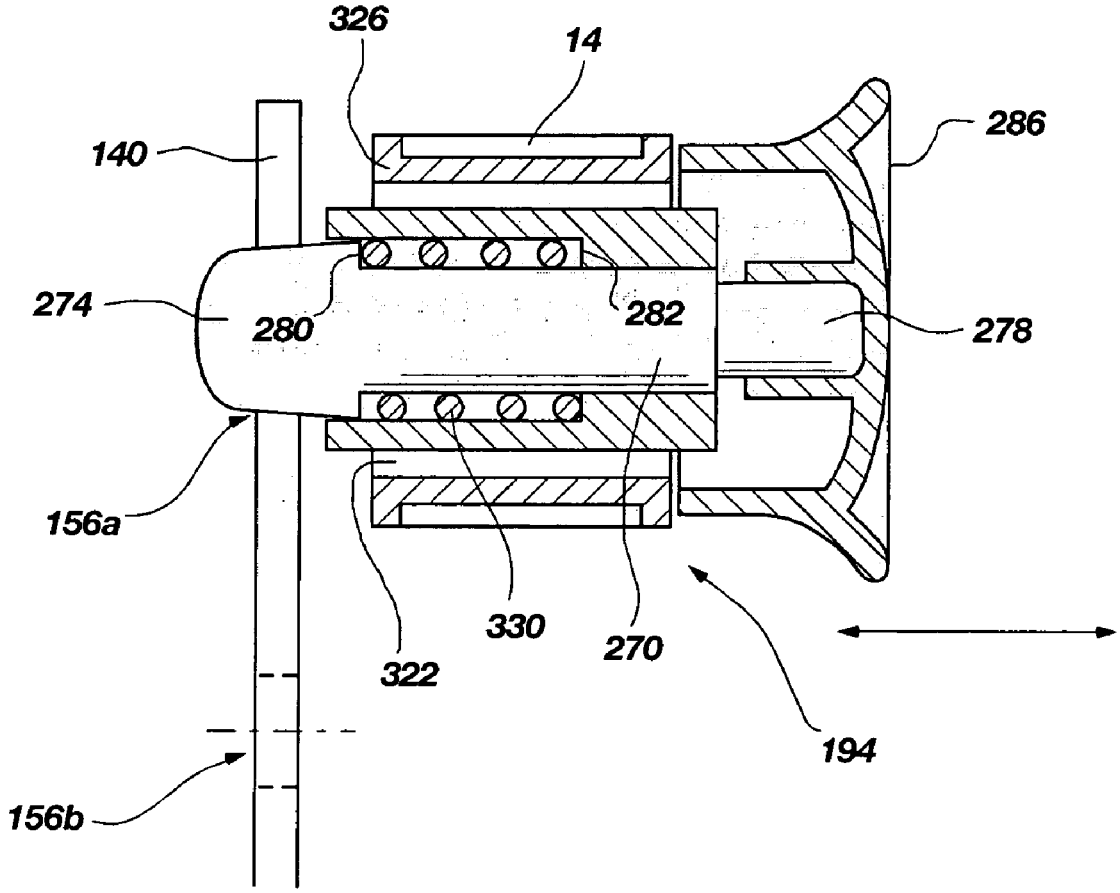
FIG. 8 illustrates a detailed side view of the coupling configuration and adjustment mechanism according to one exemplary embodiment of the present invention.

The pin 270 may be slidably coupled within the strut 194 using any known means (see FIG. 8 for one exemplary embodiment). In the embodiment shown in FIG. 2, the pin 270 is coupled to or otherwise formed with a handle portion 286 graspable by the user to facilitate the release of the pin 270 from the current adjustment aperture. Once released, the strut 194 may be relocated to another position by rotating the link 220 about its pivot point 234 until the pin 270 engages a different adjustment aperture. Rotation of the link 220 and insertion of the pin 270 into another adjustment aperture subsequently causes the radial offset position of the reciprocating foot support 14 to change with respect to the first pivot axis 152, thus altering the stride length of the exercise machine 10. For example, as shown, the pin 270 is inserted into the adjustment aperture 156-*a*, which provides for the furthest available radial offset. However, to change the stride length, the user simply pulls on the handle portion 286, thus releasing the pin 270 from the adjustment aperture 156-*a*, rotates the strut 194 to align the pin 270 with any one of the remaining available adjustment apertures 156-*b* and 156-*c*, and then releases the handle portion 286 to cause the pin 270 to insert into or otherwise engage the adjustment aperture of choice. Since the radial locations of each of the various adjustment apertures about the crank 140 differ with respect to the first pivot axis 152, the resulting radial offset of the reciprocating foot support 14 about the crank 140 is changed. Flow the stride length is affected by the described change in radial offset of the reciprocating foot support is discussed more fully below.

The second reciprocating foot support 44 comprises a similar coupling configuration and adjustment mechanism as just described, with a pin (not shown) being slidably contained within the strut 206 and configured to selectively engage one of a plurality of adjustment apertures, shown as adjustment apertures 176-*a*, 176-*b*, and 176-*c*, formed in the crank 160 upon rotating the link 240 about its pivot point 254 to reposition the strut 206 and align the pin with the desired adjustment aperture. The adjustment apertures function to define the several available adjustment positions. It is noted herein that the adjustment apertures formed in the cranks need not be throughholes. In addition, any number of adjustment apertures is intended and contemplated herein, as is their radial location with respect to the first pivot axis. As such, those embodiments shown in the drawings and discussed herein are not meant to be limiting in any way.

Figure 3:
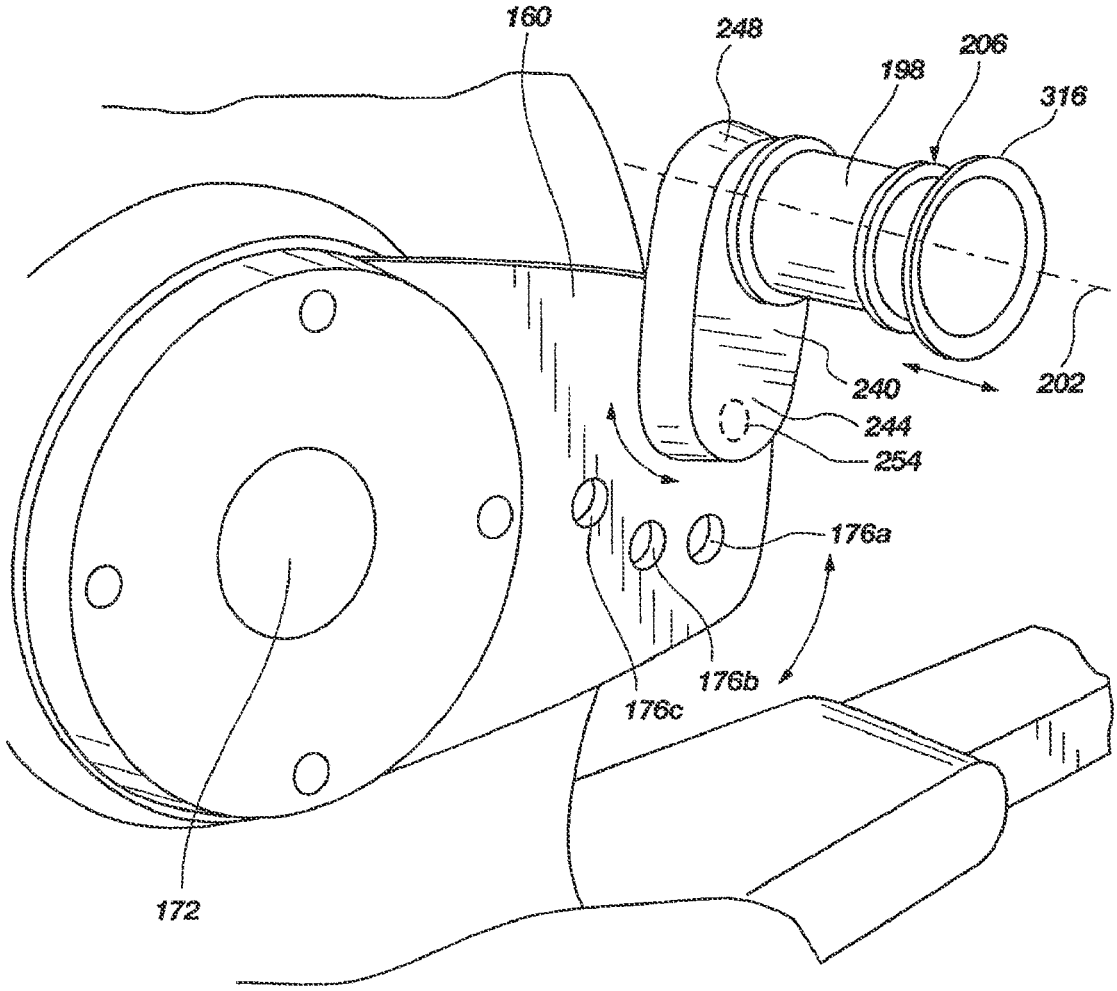
FIG. 3 illustrates a detailed perspective view of the coupling configuration and adjustment mechanism of the exercise machine depicted in FIG. 1.

With reference to FIG. 3, illustrated is a detailed perspective view of the second crank 160 of the exemplary exercise machine of FIG. 1 and the exemplary coupling configuration and adjustment mechanism just described. Specifically, FIG. 3 illustrates the link 240 as being rotated about its pivot point 254 to a position away from the crank 160 so that the pin (not shown) is not engaged with any of the adjustment apertures 176. FIG. 3 also illustrates the strut 206 extending from the distal end 248 of the link 240 without the reciprocating foot support attached to illustrate the rotating collar 198. The reciprocating foot support (not shown) comprises an axis of rotation 202 when coupled to the strut 206. As can be seen, the axis of rotation is configured to be radially offset from the pivot point 172 of the crank 160 upon the pin (not shown) contained or supported within the strut 206 being aligned with and engaging any one of the adjustment apertures 176, as intended.

The crank 160 comprises a plurality of adjustment apertures, namely adjustment apertures 176-*a*, 176-*b*, and 176-*c* formed therein. The adjustment apertures are each located at a different radial offset position so as to be able to adjust the relative offset position of the reciprocating foot support with respect to the first pivot axis when attached to the strut 206. The adjustment apertures 176 may further be located along the longitudinal axis of the crank, or offset some length from the longitudinal axis of the crank. In this embodiment, the adjustment apertures are formed along a curve with the adjustment aperture 176-*a* being located in a radial offset position furthest from the first pivot axis 172 and in an offset position furthest from a longitudinal axis of the crank 160. The longitudinal axis of the crank 160 (or drive component as referred to herein) may be referenced as running lengthwise along the crank 160, through or intersecting the first pivot axis to symmetrically divide the crank 160, as commonly known in the art. In this configuration, as the link 240 is caused to rotate about the pivot point 254 formed in its proximal end 244, the pin contained within the strut 206 may be properly and selectively aligned with any one of the adjustment apertures 176 simply by manipulating the link 240 into a position where the pin is capable of engaging the selected adjustment aperture. In other words, the relative distance of a center axis of the pin from the second pivot axis 254 corresponds to a relative distance of the center axis of each of the adjustment apertures from the second pivot axis 254. Although the link 240, as shown, traces a circular path, it may also be configured to trace an eccentric path, thus providing eccentric formation and location of adjustment apertures about the crank 160. In addition, the adjustment apertures 176 may be oriented about a common linear axis, such as the longitudinal axis, depending upon the type of coupling configuration and adjustment assembly employed.

FIG. 3 further illustrates identifiers for assisting the user in identifying the stride length that will result from particular adjustments made. For example, FIG. 3 illustrates that the exercise machine will comprise a stride length of 18 inches if the adjustment mechanism is set to engage the adjustment aperture 176-*a*. Likewise, the stride length will be 14 inches if the adjustment mechanism is set to engage the adjustment aperture 176-*b*, and 12 inches if set to engage the adjustment aperture 176-*c*. Obviously, these stride length distances may be different depending upon the radial offset location of the adjustment apertures and the corresponding radial offset of the axis of rotation.

Figure 4:
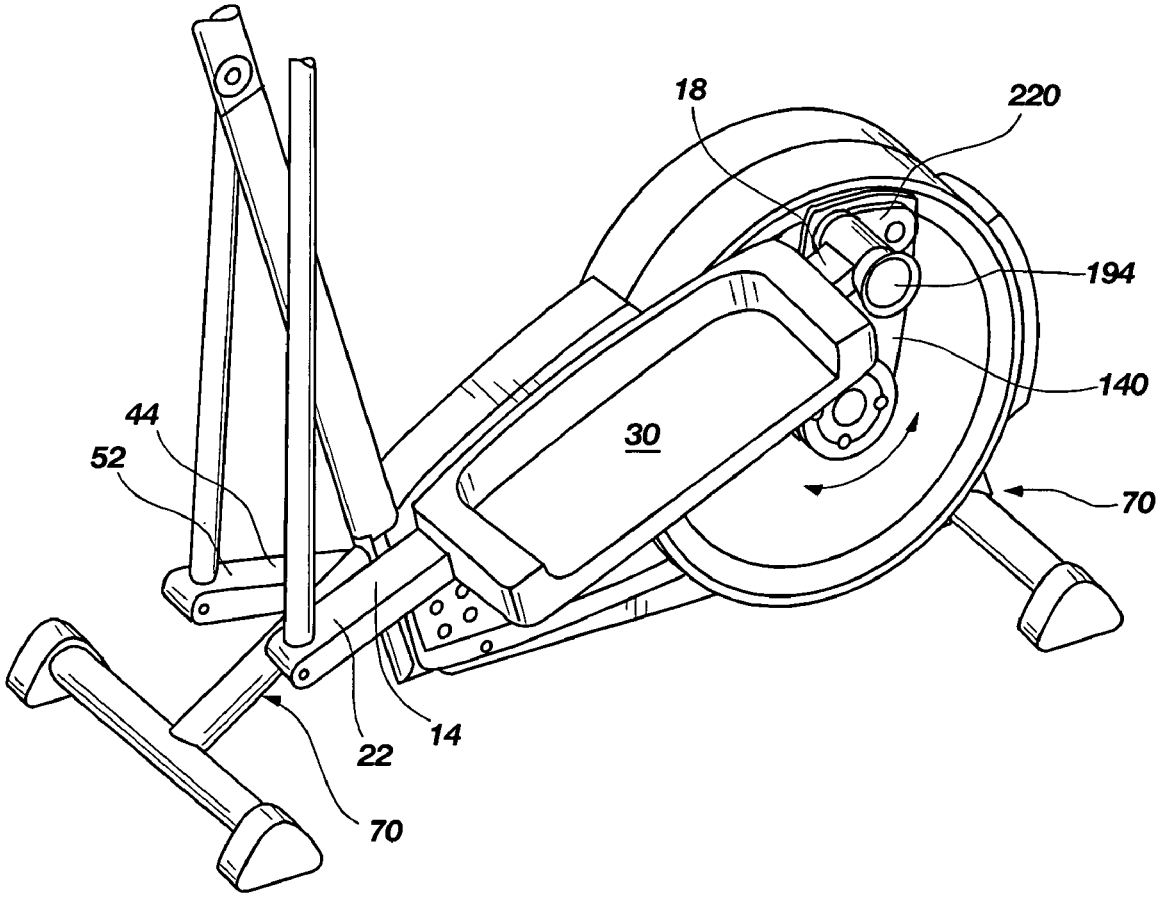
FIG. 4 illustrates a perspective view of an exercise machine according to another exemplary embodiment of the present invention, wherein the support structure and resulting foot print of the exercise machine are compacted, thus allowing the foot pads to be located near the ends of the reciprocating foot supports.
Figure 5:
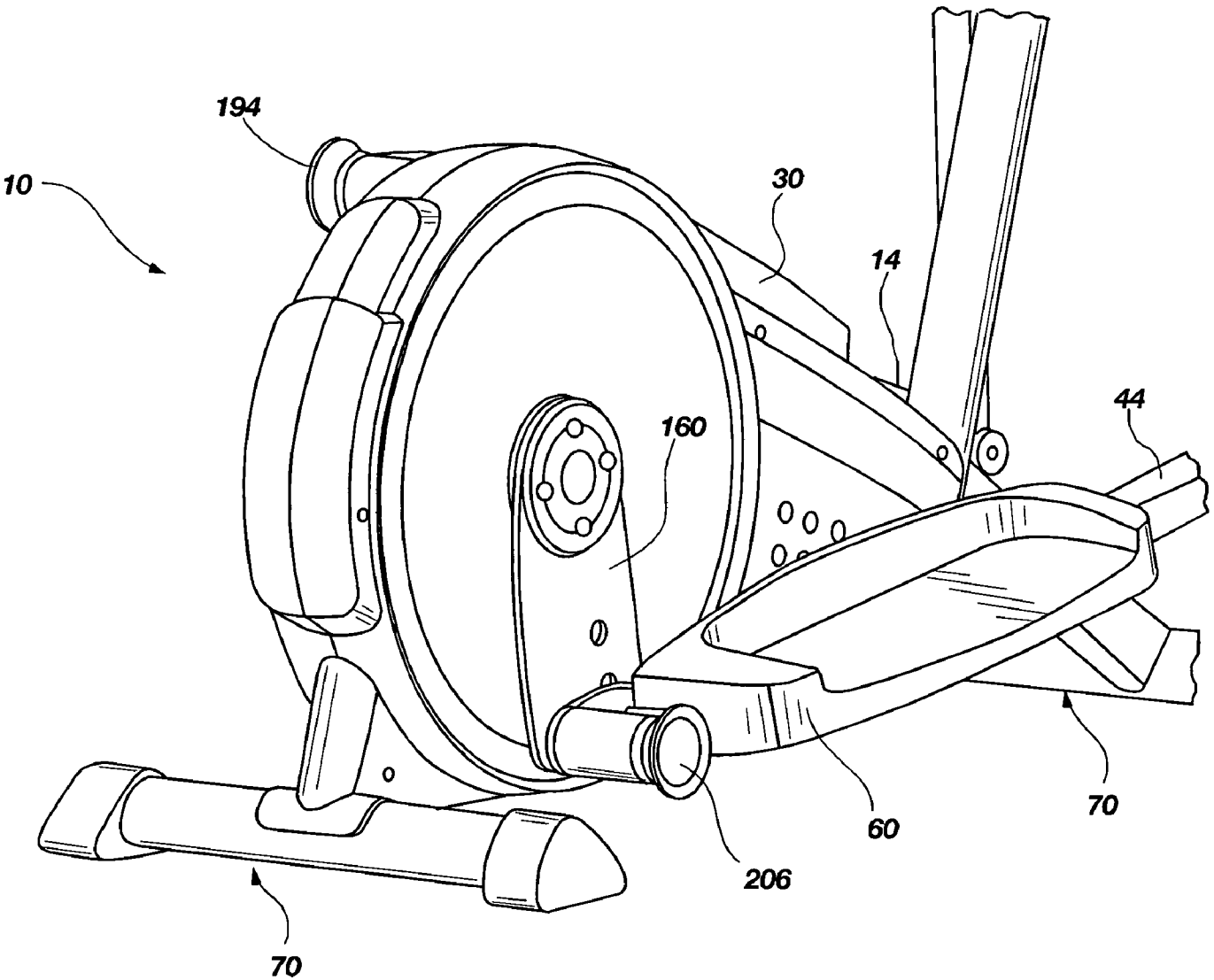
FIG. 5 illustrates a perspective rear view of the exercise machine of FIG. 4.

With reference to FIGS. 4 and 5, illustrated are perspective views of an exercise machine according to another exemplary embodiment of the present invention, wherein the support structure and resulting foot print of the exercise machine are comprised in a relatively compact configuration, thus allowing the foot pads to be located near the first or proximal ends of the reciprocating foot supports. Specifically, FIGS. 4 and 5 illustrate the exercise machine 10-*b* as comprising many of the same components of the exercise machine of FIG. 1. As such, many of these are not specifically discussed herein, but are instead incorporated by reference, where applicable. In this embodiment, the support structure 70 comprises a relatively compact design allowing the size of the exercise machine 10-*b* to be significantly reduced. As a result of the compact design, the reciprocating foot supports 14 and 44 comprise foot pads 30 and 60, which are configured to be located between the first ends 18 and 48 and the second ends 22 and 52 of the reciprocating foot supports 14 and 44, respectively, are located more about the first or proximal ends 18 and 48 of the reciprocating foot supports 14 and 44, which first or proximal ends 18 and 48 are defined as those nearest and coupled to the struts 194 and 206 used to relate and couple the reciprocating foot supports 14 and 44 to the drive components or cranks 140 and 160, respectively.

The exercise machine 10-*b* further comprises means for coupling the reciprocating foot supports 14 and 44 to the cranks 140 and 160, which means may comprise several different types of coupling configurations. In addition, the exercise machine 10-*b* comprises means for varying its stride length, which means may comprise any number of adjustment systems or mechanisms.

The compact design of the exercise machine 10-*b* of FIGS. 4 and 5 allows it to take up less room, which can be significant if used in a home setting. In addition, the ability to adjust or vary the stride makes a compact design economical and beneficial even to those having long strides, since the stride length can be adjusted to accommodate those users, while also accommodating users with shorter strides.

Figure 6:
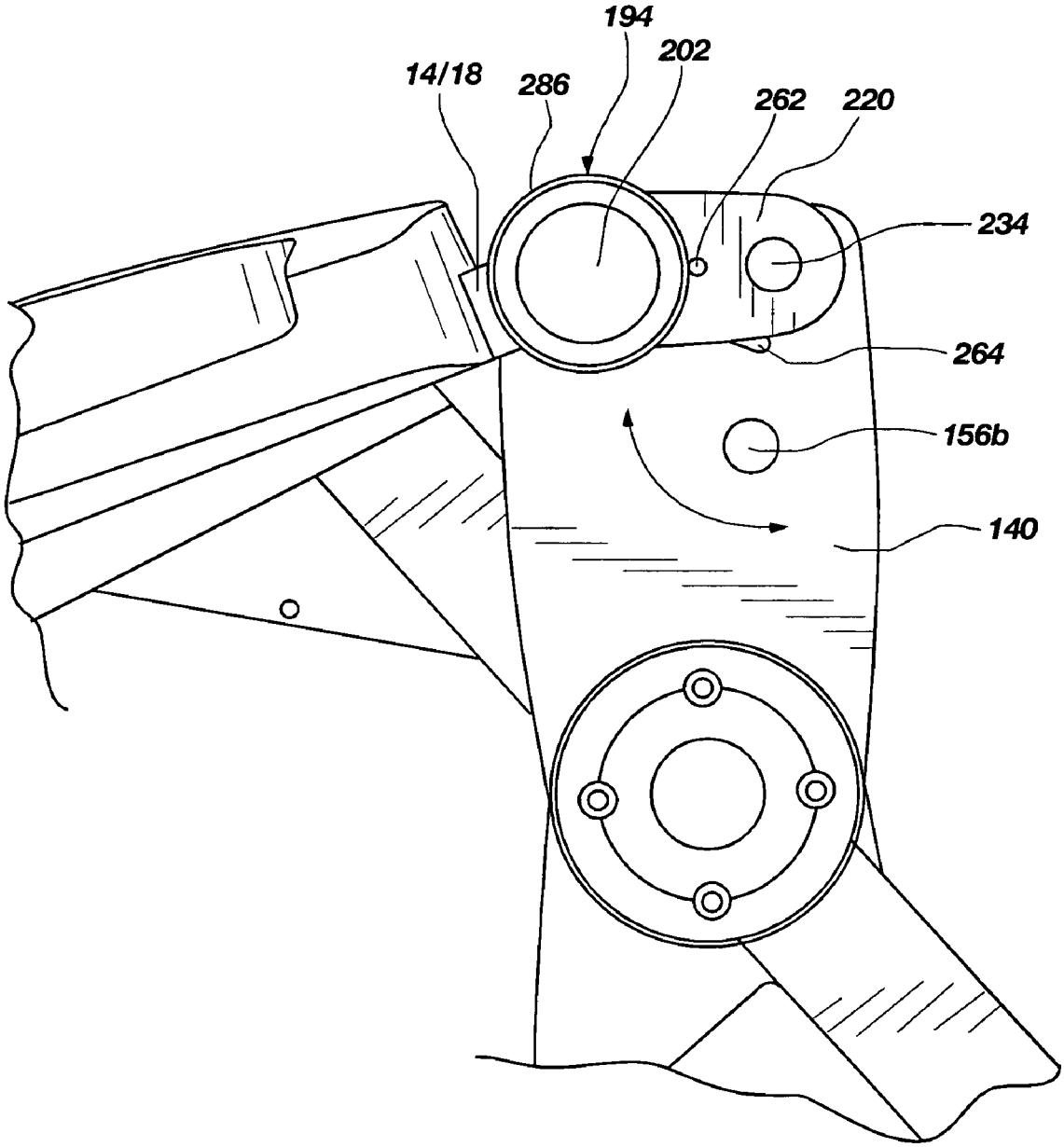
FIG. 6 illustrates a detailed side view of the exercise machine of FIG. 4 depicting a coupling configuration and adjustment system according to one exemplary embodiment of the present invention, wherein the adjustment system comprises a biased pin or boss contained within the coupling configuration that is capable of selectively engaging one of a plurality of adjustment apertures formed in a crank-type drive component.

With reference to FIG. 6, illustrated is a detailed view of the coupling configuration used to couple the proximal or first end 18 of the reciprocating foot support 14 to the crank 140, as well as the adjustment assembly configured to facilitate the adjustment of the axis of rotation 202 of the reciprocating foot support 14 with respect to the first pivot axis 152. As can be seen, these are similar to those discussed above with respect to the exercise machine 10 shown in FIGS. 1-3, such as the use of a strut 194, which description is incorporated herein, where applicable. The coupling configuration of the exercise machine 10-*b*, and particularly the link 220, further comprises a guide pin 262 retained therein. The guide pin 262 is configured to slidably engage a corresponding slot 264 formed in the crank 140 to assist the rotation of the link 220 about its pivot point 234 back and forth between adjustments. The guide pin 220 also functions as a limiting member to limit the allowable travel distance of the link 220. Thus, in one aspect, the ends of the slot 264 may serve as stoppers and may be configured to prohibit further rotation of the link 220. The slot may also be configured so that each end stops the rotation of the link 220 at a position where the pin 270 is properly aligned to engage an adjustment aperture, such as adjustment aperture 156-*b*.

Figure 7:
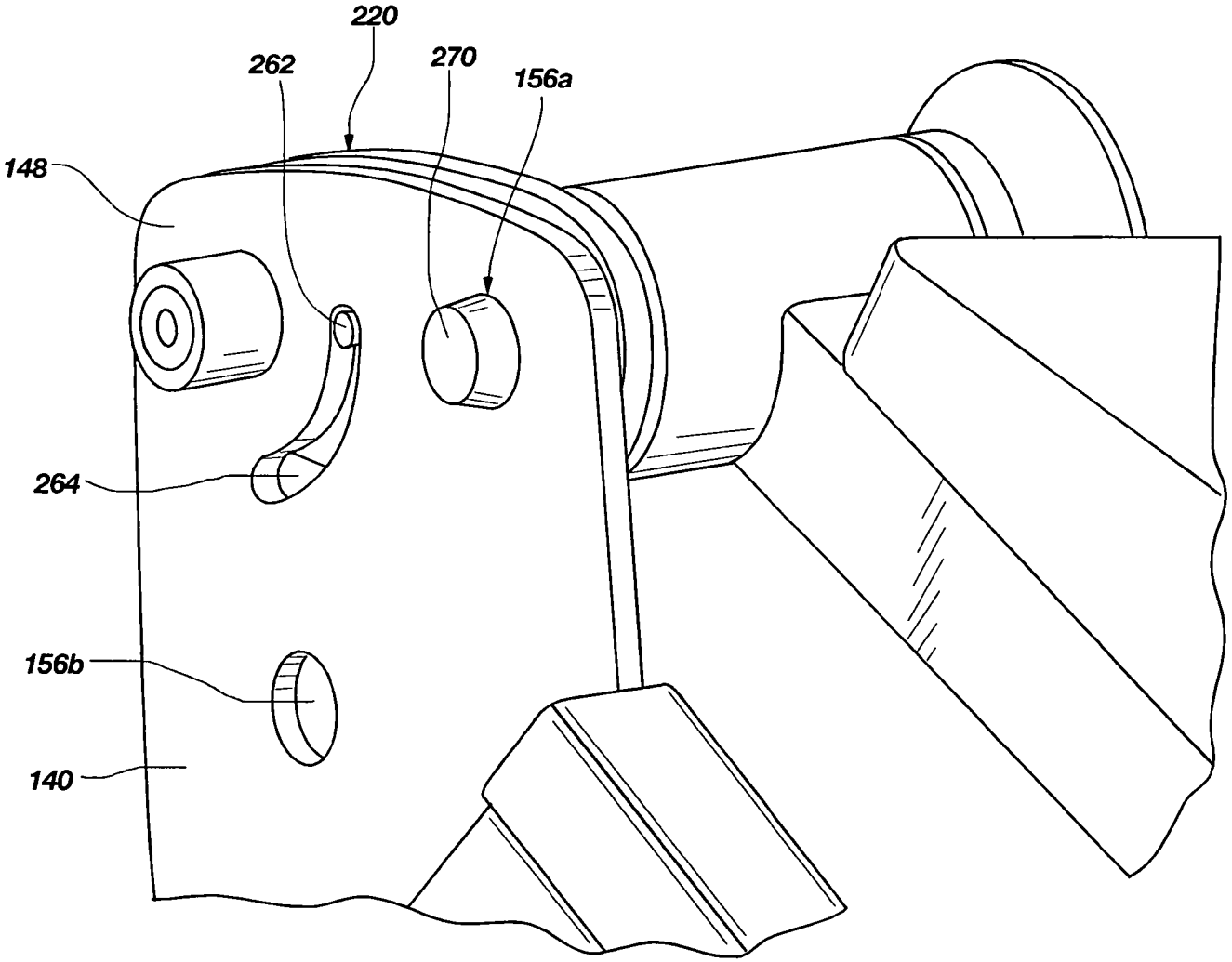
FIG. 7 illustrates a detailed perspective view of the rear side of the coupling configuration and adjustment system or mechanism of the exercise machine depicted in FIG. 4.

FIG. 7 illustrates a detailed rear view of the crank 140 and the coupling configuration and adjustment assembly of FIG. 6. As shown, the link 220 is rotatably coupled to the crank 140 at its distal end 148 and rotated so that pin 270 is engaged within the adjustment aperture 156-*a*. In this position, the guide pin 262 is adjacent one end of the slot 264, thus preventing any further rotation of the link 220 away from the proximal end of the crank 140. The configuration of the slot 264 and the guide pin 262 only allow rotation of the link 220 toward the proximal end of the crank 140 for the purpose of aligning the pin 270 with the adjustment aperture 156-*b* to adjust the stride length, and particularly to shorten the stride length.

FIG. 7 further illustrates the retaining assembly used to rotatably couple the link 220 to the crank 140. In the embodiment shown, the retaining assembly comprises a bushing 232 securely coupled within the crank 140 using any known securing means.

With reference to FIG. 8, the adjustment mechanism may comprise a strut 194 having a slidable or displaceable boss or pin 270 supported therein for selectively and releasably engaging one or more adjustment apertures 156-*a* and 156-*b* formed in a drive component or crank 140. As shown, the strut 194 comprises a bushing or bearing 322 configured to rotatably couple on end portion of the reciprocating foot support 14. The bearing 322 may be disposed within a support structure 326 in the form of a rotatable collar designed to receive the end of the reciprocating foot support 124 and facilitate its rotation, or it may comprise the exterior surface of the strut, being configured to receive a tube or collar formed on the end of the reciprocating foot support 14. In any event, the present invention contemplates any known means or methods used to rotatably couple or otherwise relate the end of the reciprocating foot support 14 to the crank 140.

The strut 194 further comprises a pin 270 supported within the strut 194. The pin 270 is slidably supported. The pin 270 comprises a first end 274 extending from the strut 194 a suitable distance so as to engage a selected adjustment aperture 156. The opposing second end 278 of the pin 270 is secured to a handle 286. The handle is configured to be pulled by a user to retract the first end 274 of the pin 270 from the adjustment aperture 156 and to facilitate the repositioning of the pin 270 to engage a different adjustment aperture, such as adjustment aperture 156-*b*. The pin 270 comprises a ledge 280 configured to engage a similar ledge 282 formed in the support structure of the strut 194, thus preventing the pin 270 from being removed from the strut 194. However, the ledges are spaced apart a sufficient distance to allow the pin 270 to extend and retract as intended. The strut 194 may further comprise biasing means, such as a spring 330, configured to bias the pin 270 to its fully extended position, such as when inserted into an adjustment aperture. The biasing means functions to prevent inadvertent disengagement of the pin 270 from the selected adjustment aperture.

Figure 9:
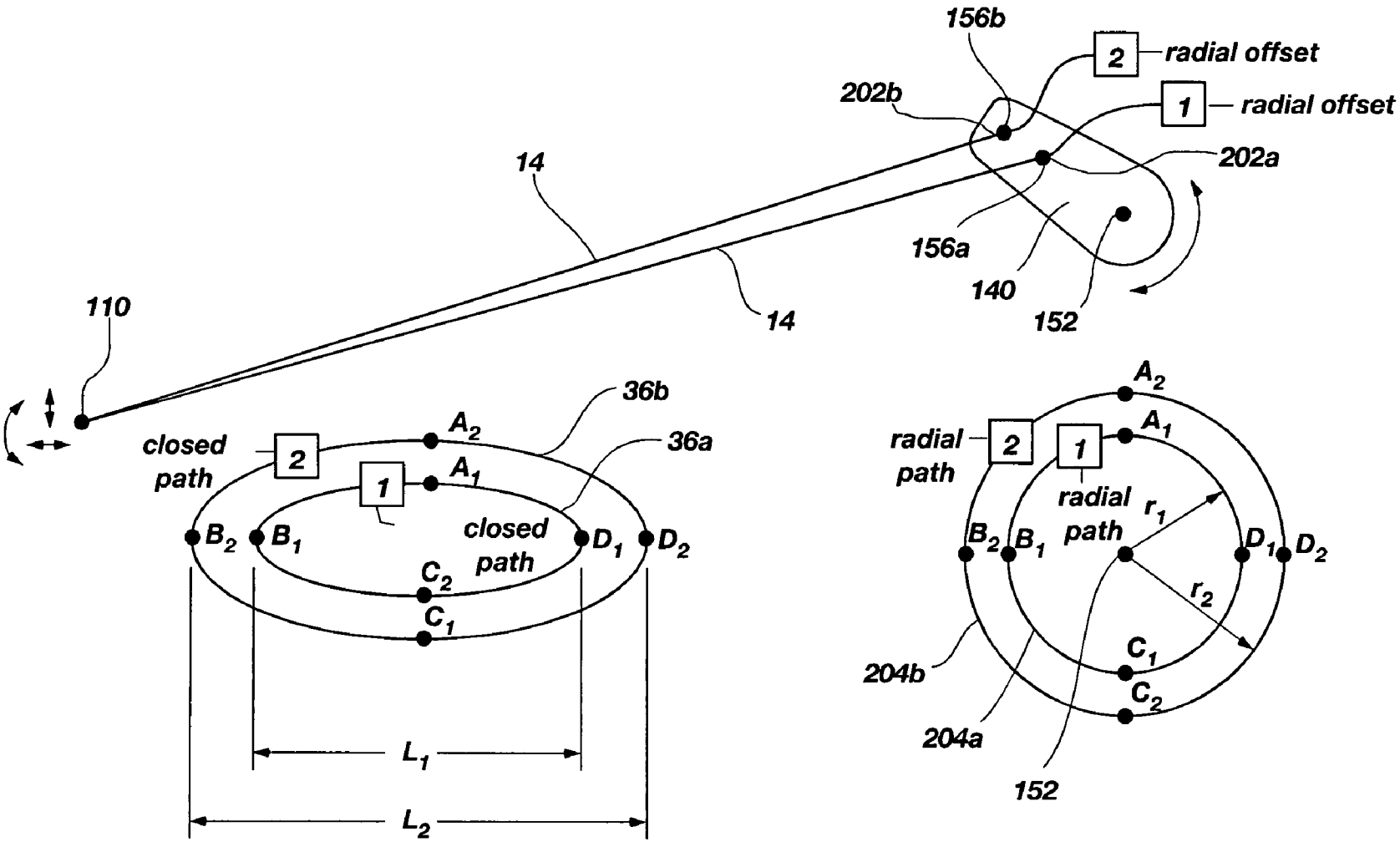
FIG. 9 illustrates a depiction of the closed path resulting from the rotation of the drive component and the relative offset of the axis of rotation of the reciprocating foot support with respect to the pivot point of the drive component.

With reference to FIG. 9, illustrated is a depiction of the closed path resulting from the rotation of the drive component and the relative offset of the axis of rotation of the reciprocating foot support with respect to the pivot point of the drive component, all according to one exemplary embodiment. As can be seen, the drive component, shown as crank 140, is configured to travel about a circular path. In other embodiments, the drive component may travel an eccentric path. With one end of the reciprocating foot support 14 rotatably coupled to the crank 140 at any one of a plurality of locations, the reciprocating foot support 14 comprises a resulting axis of rotation 202 radially offset from the pivot point 152 of the crank 140. With the opposite end of the reciprocating foot support 14 rotatably supported at a pivot point 110 to move in any direction, the reciprocating foot support 14 traverses an oblong or elliptical closed path, shown as closed path 36.

The crank 140 comprises a plurality of adjustment apertures, shown as adjustment apertures 156-*a* and 156-*b*, formed therein as discussed above. These adjustment apertures are located at a radial offset position from the pivot point 152. The reciprocating foot support 14 may selectively attach to either of these adjustment apertures depending upon the desired stride length.

When attached to the adjustment aperture 156-*a*, the reciprocating foot support comprises an axis of rotation 202-*a* radially offset from the pivot point 152, which radial offset is labeled as 1. As the crank 140 is caused to rotate about the pivot point 152, the axis of rotation 202-*a* at the radial offset 1 traverses about a radial path, which is depicted directly below the crank 140, and labeled as first radial path 204-*a*. This first radial path 204-*a* comprises a radial offset from the pivot point 152, which radial offset comprises a distance $r_1$.

Concurrent with the rotation of the crank 140, the reciprocating foot support 14 traverses about a closed path, shown as closed path 36-*a*. Radial path 1 traversed by the axis of rotation 202-*a* corresponds to closed path 1 traversed by the reciprocating foot support 14. The closed path 36-*a* comprises a stride length having a distance $L_1$, as measured from the two furthest opposing points situated about the closed path 36-*a* and intersecting a longitudinal axis of the closed path 36-*a*. This distance $L_1$ is commonly referred to as stride length and is the length intended to be adjustable according to the teachings herein.

When attached to the adjustment aperture 156-*b*, the reciprocating foot support comprises an axis of rotation 202-*b* radially offset from the pivot point 152, which radial offset is labeled as 2. As the crank 140 is caused to rotate about the pivot point 152, the axis of rotation 202-*b* at the radial offset 2 traverses about a radial path, which is depicted directly below the crank 140, and labeled as second radial path 204-*b*. This second radial path 204-*b* comprises a radial offset from the pivot point 152, which radial offset comprises a distance $r_2$.

Concurrent with the rotation of the crank 140, the reciprocating foot support 14 traverses about a closed path, shown as closed path 36-*b*. Radial path 2 traversed by the axis of rotation 202-*b* corresponds to closed path 2 traversed by the reciprocating foot support 14. The closed path 36-*b* comprises a stride length having a distance $L_2$, as measured from the two furthest opposing points situated about the closed path 36-*b* and intersecting a longitudinal axis of the closed path 36-*b*.

Reference letters $A_1$-$A_4$ represent the relative positions of the axis of rotation 202 and the reciprocating foot support 14 about their respective paths during operation of the exercise machine with the axis of rotation 202 set at the radial offset 1. Likewise, reference letters $B_1$-$B_4$ represent the relative positions of the axis of rotation 202 and the reciprocating foot support 14 about their respective paths during operation of the exercise machine with the axis of rotation 202 set at the radial offset 2.

As can be seen, the stride length $L_1$ resulting from the axis of rotation 202 being set at the radial offset 1 is shorter than the stride length $L_2$ resulting from the axis of rotation being set at the radial offset 2. The difference between these distances or stride lengths may be pre-determined and dependent upon the location of the various available radial offsets of the axis of rotation with respect to the pivot point 152 of the crank 140. Nonetheless, utilizing the adjustment mechanisms described herein, the stride length is easily adjusted or varied simply by relocating or adjusting the radial offset of the axis of rotation of the reciprocating foot support with respect to the pivot point of the crank.

It will be obvious to one skilled in the art that the second reciprocating foot support (not shown) functions in the same way, even though such is out of phase 180° and is not specifically set forth herein.

With reference to FIGS. 10-A and 10-B, illustrated is a coupling configuration according to another exemplary embodiment. In this particular embodiment, the reciprocating foot support 414 comprises in one end an engagement member 440 configured to be supported by the reciprocating foot support 414 and to releasably engage one or more corresponding receivers, such as a plurality of apertures or slots, formed within the drive component or crank 540 (see FIGS. 11 and 12), which receivers or slots function to define at least two adjustment positions for locating the reciprocating foot support about the drive component 540. The engagement member 440 is configured to releasably secure or couple to the crank using any suitable means known in the art. In one aspect, the engagement member 440 comprises a rotatable engagement member designed to releasably engage the receiver formed in the drive component and to rotate therein. In other words, the reciprocating foot support comprises and supports the rotation components configured to allow the reciprocating foot support to rotate about the crank.

In another aspect, the drive component itself comprises the necessary rotation components. For example, the receivers formed within the drive component and comprising the at least two adjustment positions may be configured with the rotation components needed for facilitating the rotation of the reciprocating foot support, and particularly the engagement member contained therein, about the crank at the various adjustment positions.

It is also contemplated that, with respect to this embodiment, the exercise machine will comprise a sufficient and capable coupling configuration configured to adequately support the reciprocating foot supports and their adjustability during use of the exercise machine. The types of coupling configurations that may be used for these purposes are not specifically set forth herein, but are well known in the art.

Figure 10B:
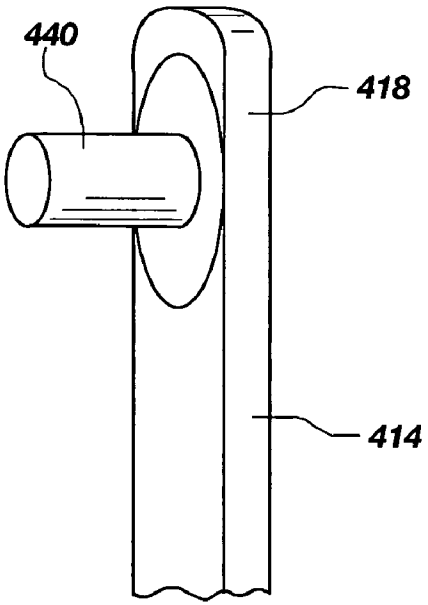
FIG. 10-A illustrates a perspective view of one end of a reciprocating foot support comprising a rotating boss supported in an end thereof, wherein the rotating boss is configured to facilitate the coupling of the reciprocating foot support to the drive component, as well as to selectively engage one of a plurality of corresponding apertures, slots, or other configurations formed in the drive component for varying the stride length of the reciprocating foot support.
Figure 10A:
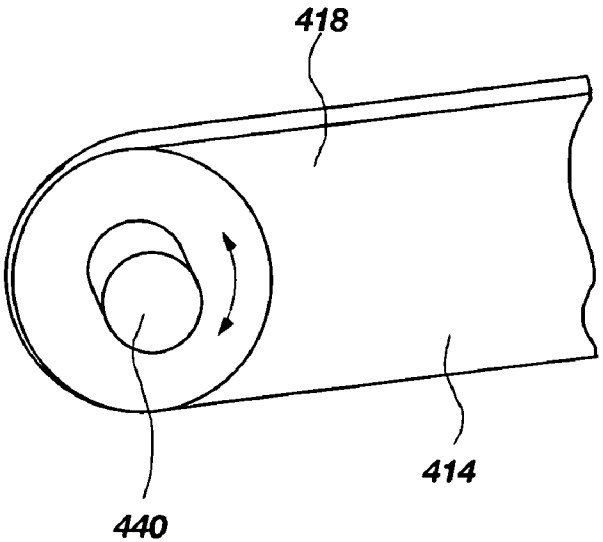
Figure 11:
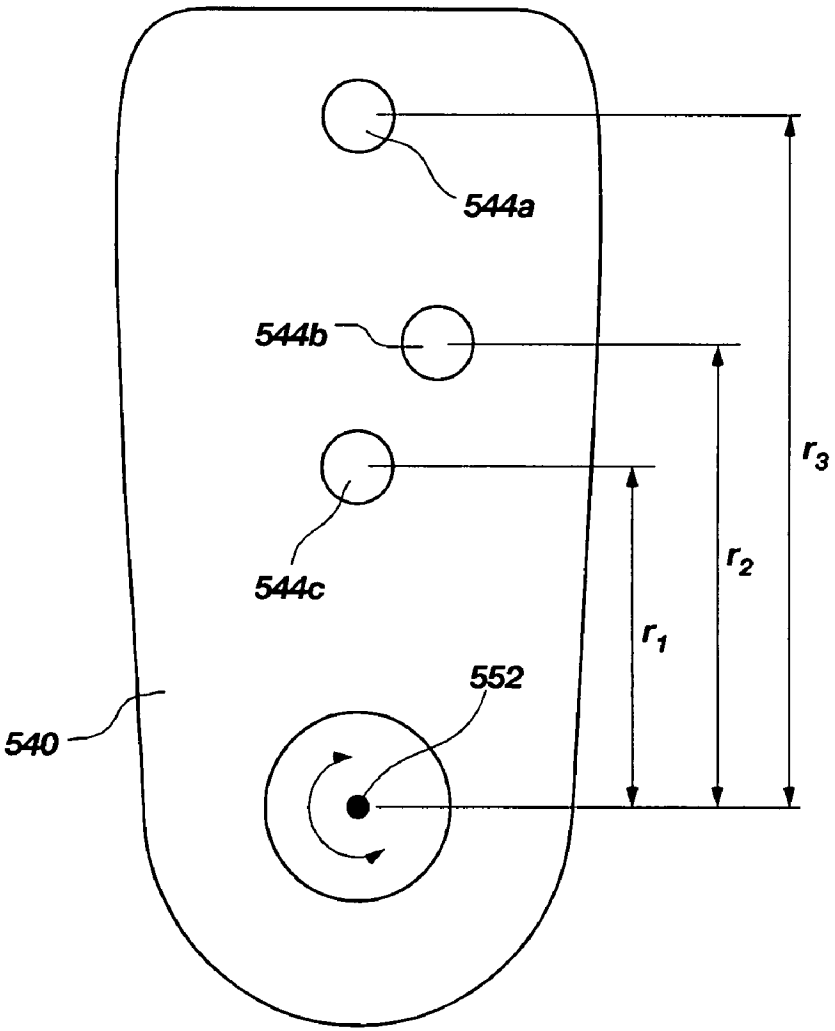
FIG. 11 illustrates a detailed front view of a drive component in the form of a crank comprising a plurality of adjustment apertures formed at different locations within the crank, wherein the several adjustment apertures are configured to facilitate the selective attachment of the reciprocating foot support to the crank and also the selective positioning of the axis of rotation of the reciprocating foot support with respect to the pivot point of the drive component to vary stride length.

FIG. 11 illustrates a drive component, in the form of a crank 540, wherein the crank 540 comprises a plurality of receivers 544 configured to provide a plurality of radial offsets for an axis of rotation, which radial offsets comprise distances $r_1$, $r_2$, and $r_3$, respectively, with respect to the pivot point 552. The receivers 544 may comprise adjustment apertures for receiving a boss or pin as discussed herein, or they may comprise other types of receivers configured to releasably engage a rotatable engagement member, such as the one shown in FIGS. 10-A and 10-B and discussed above. The receivers 544 may be located along or offset from a longitudinal axis of the crank.

Figure 12:
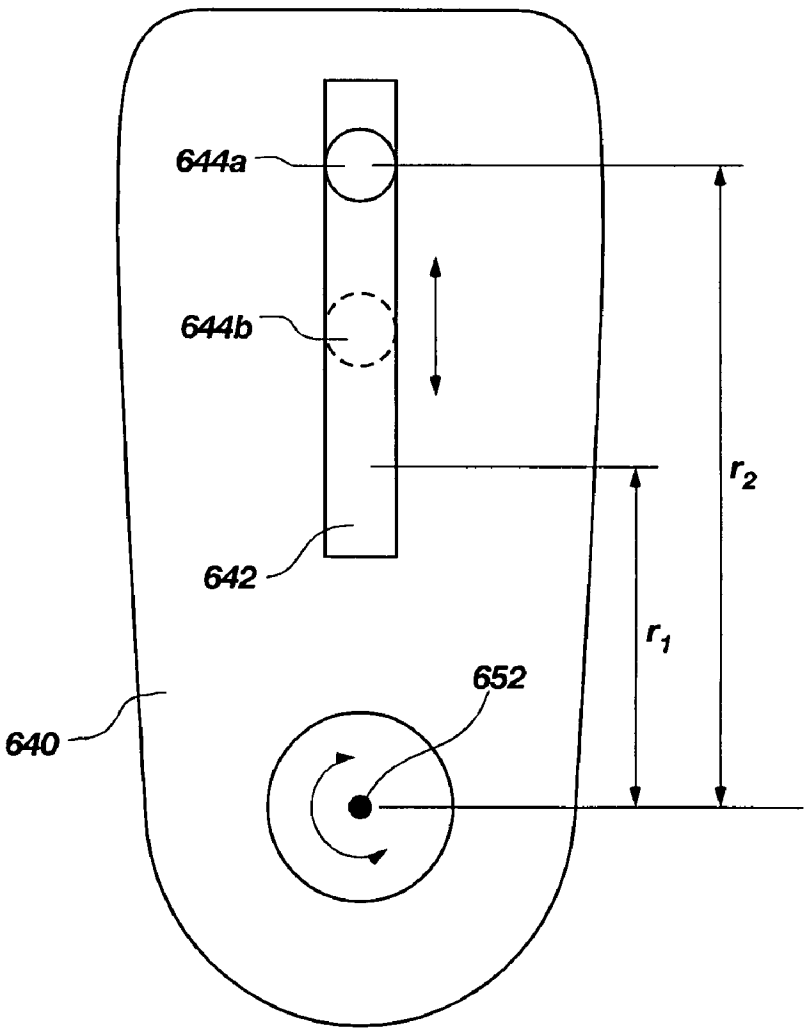
FIG. 12 illustrates a detailed front view of a drive component in the form of a crank comprising a slot formed about a longitudinal axis of the crank, wherein the slot is configured to facilitate the selective attachment of the reciprocating foot support to the crank and also the selective positioning of the axis of rotation of the reciprocating foot support with respect to the pivot point of the drive component to vary stride length.

FIG. 12 illustrates another exemplary embodiment of a drive component, also in the form of a crank 640, wherein the crank 640 comprises a slot 642 formed therein, which slot further defines at least two adjustment positions for locating the reciprocating foot support about the crank. The slot 642 is formed at a radially offset position from the pivot point 652 of the crank 640 and is configured to slidably and rotatably and releasably engage a pin or rotatable engagement member, as discussed herein. Although not shown, the slot 642 may be formed on an incline, along a curve, or along the longitudinal axis of the crank 640.

It is noted herein that the struts, as described above, may be utilized with or without a linking configuration. In other words, it is contemplated that the struts discussed above may be coupled directly to the drive components or cranks without the need for a connecting link. The struts in this configuration may still be adjustable by providing an adjustment mechanism or means for adjusting the struts between at least two adjustment positions with respect to the first or crank pivot axis. For example, the struts may be coupled directly to any one the adjustment apertures formed in the drive component shown in FIG. 11, or the slot formed in the drive component shown in FIG. 12. In this configuration, the struts are designed to function in a similar way as discussed above, only without being coupled to a pivoting link. As such, it is contemplated that the struts will be appropriately secured to the drive component using a sufficiently strong and capable coupling configuration as known in the art. The types of coupling configurations that may be employed are not specifically set forth herein, as the primary focus of the invention remains the adjustability of the struts with respect to the first or crank pivot point to vary the offset position of the struts, and therefore the axis of rotation of the struts and the reciprocating foot support supported thereon, with respect to the first pivot axis.

Figure 13:
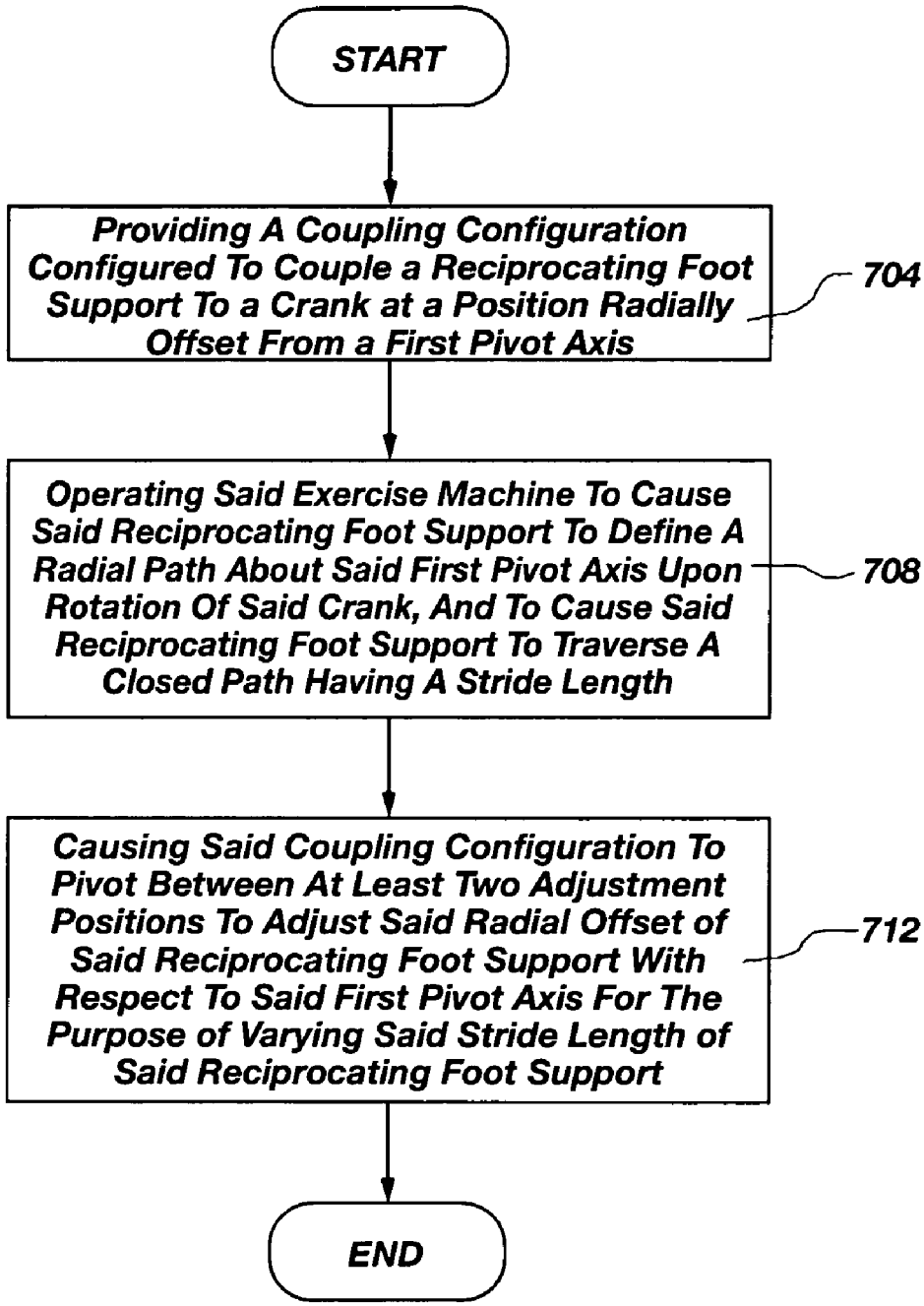
FIG. 13 illustrates a flow diagram of a method for varying the stride length of an exercise machine, according to one exemplary embodiment of the present invention.

FIG. 13 illustrates a flow diagram of an exemplary method for varying stride length on an exercise machine. The method comprises step 704, providing a coupling configuration configured to couple a reciprocating foot support to a crank at a position radially offset from a first pivot axis. The coupling configuration is similar to those described above. The method further comprises, step 708, operating the exercise machine to cause the reciprocating foot support to define a radial path about the first pivot axis upon rotation of the crank, and to cause the reciprocating foot support to traverse a closed path having a stride length. As an additional step, the method comprises, step 712, causing the coupling configuration to pivot between at least two adjustment positions to adjust the radial offset of the reciprocating foot support with respect to the first pivot axis for the purpose of varying the stride length of the reciprocating foot support. This method step involves utilizing a manual or electronic adjustment system or mechanism to accomplish the adjustment. As such, different individuals with different strides or stride lengths can use the same machine at the same level of comfort. The method further comprises adjusting the radial offset of the reciprocating foot support to accommodate a different user having a different stride length.

Figure 14:
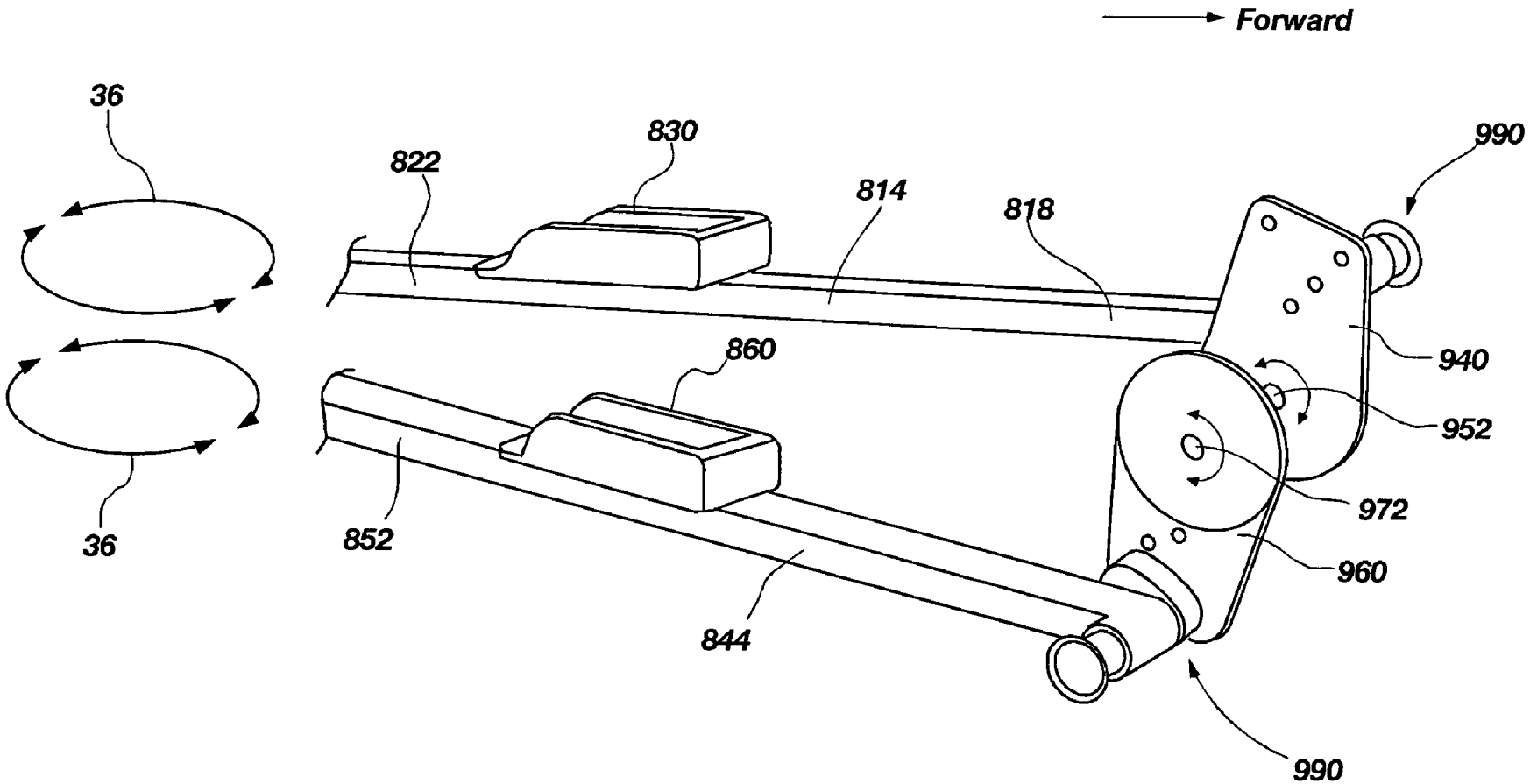
FIG. 14 illustrated is a partial and general perspective view of a front mechanical-type exercise machine according to one exemplary embodiment, thus depicting the ability of the present invention variable stride adjustment may be incorporated into a front mount or front mechanical-type exercise machine.

As generally noted above, the above-described present invention methods and systems may also be incorporated into a front mount or front mechanical-type exercise machine, wherein the drive component and/or crank assembly is supported about a front portion of the exercise machine, as commonly known in the art. With reference to FIG. 14, illustrated is a partial and general perspective view of a front mechanical-type exercise machine according to one exemplary embodiment. As shown, the exercise machine comprises first and second reciprocating foot supports 814 and 844 having foot pads 830 and 860 positioned thereon, respectively. The first ends 818 and 848, respectively, are coupled to cranks 940 and 960, which are configured to rotate about pivot points 952 and 972, respectively, thereby inducing a closed path 36 in each of the reciprocating foot supports. Coupling configuration 990 functions to adjustably couple the first and second reciprocating foot supports 814 and 844 to the cranks 940 and 960, respectively. In addition, an adjustment mechanism is provided to allow the radial offset of the axis of rotation of the reciprocating foot supports 814 and 844, respectively, to be selectively adjusted. Each of these concepts are similar to those discussed above. They are configured to function in a similar way, the primary difference being that they are made operable on a front mount or front mechanical-type exercise machine, as indicated by the forward directional arrow.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are expressly recited. Accordingly, the scope of the invention should be determined solely by the appended claims and their legal equivalents, rather than by the descriptions and examples given above.

What is claimed and desired to be secured by Letters Patent is:

1. An exercise machine comprising:

a support structure;

a drive component coupled to said support structure and configured to rotate about a first pivot axis;

a reciprocating foot support configured to travel about a closed path having a stride length upon rotation of said drive component, said reciprocating foot support having (i) a front end pivotally linked to said support structure, (ii) a rearward end; and (iii) a footpad positioned therebetween;

a coupling configuration pivotally coupling said rearward end of said reciprocating foot support to said drive component, said coupling configuration configured to support said reciprocating foot support at a position radially offset from said first pivot axis, said coupling configuration comprising a link member having (i) a first end pivotally mounted on said drive component at a second pivot axis that is offset from said first pivot axis; and (ii) a second end adapted to rotate about said second pivot axis; and an adjustment mechanism configured to enable said second end of said link member to be selectively mounted on said drive component at one of at least two discrete adjustment positions in said drive component to vary said radial offset of said reciprocating foot support with respect to said first pivot axis to thereby vary the stride length of said reciprocating foot support.

2. The exercise machine of claim 1, wherein said drive component comprises a crank.

3. The exercise machine of claim 1, wherein said drive component is configured to rotate in a manner selected from concentric rotation and eccentric rotation.

4. The exercise machine of claim 1, wherein said coupling configuration comprises:

a strut extending from said second end of said link member and configured to couple said reciprocating foot support, said strut being radially offset from said first pivot axis to provide an axis of rotation for said reciprocating foot support about said drive component.

5. The exercise machine of claim 4, wherein said adjustment mechanism comprises:

a plurality of adjustment apertures formed within said drive component, each of said adjustment apertures being configured to vary said stride length of said reciprocating foot support;

a pin contained within said strut and configured to releasably and selectively engage said adjustment apertures upon rotation of said link member about said second pivot axis to vary said stride length of said reciprocating foot support; and biasing means configured to bias said pin within said strut.

6. The exercise machine of claim 1, wherein said reciprocating foot support is further supported about said drive component at a position offset from a longitudinal axis of said drive component.

7. The exercise machine of claim 1, wherein said at least two adjustment positions are located along a curved path with respect to said first pivot axis.

8. An exercise machine comprising:

a support structure;

a drive component coupled to said support structure and configured to rotate about a first pivot axis;

a reciprocating foot support configured to travel about a closed path upon rotation of said drive component, said reciprocating foot support having a front end pivotally linked to said support structure, a rearward end, and a footpad positioned therebetween, wherein said drive component is positioned substantially behind a user when the user exercises on the exercise machine with the user's foot on said footpad;

an engagement member configured to releasably couple said rearward end of said reciprocating foot support to said drive component at a position radially offset from said first pivot axis, said engagement member configured to adjust said reciprocating foot support between at least two adjustment positions with respect to said first pivot axis to vary said radial offset of said reciprocating foot support with respect to said first pivot axis to thereby vary a stride length of said reciprocating foot support, wherein (i) a first end of said engagement member is pivotally mounted on said drive component at a second pivot axis; and (ii) a second end of said engagement member is configured to rotate about said first end of said engagement member to enable selective coupling of said second end of said engagement member to one of at least two apertures in said drive component.

9. The exercise machine of claim 8, further comprising at least two receivers formed in said drive component and configured to receive and couple said engagement member.

10. The exercise machine of claim 9, wherein said engagement member forms an axis of rotation of said reciprocating foot support about said drive component.

11. The exercise machine of claim 8, further comprising a slot formed in said drive component, said slot being configured to receive and selectively slidably engage said engagement member.

12. The exercise machine of claim 11, wherein said engagement member forms an axis of rotation of said reciprocating foot support about said drive component.

13. The exercise machine of claim 11, further comprising means for selectively securing and repositioning said engagement member within said slot.

14. The exercise machine of claim 8, wherein said reciprocating foot support is further coupled at a position offset from a longitudinal axis of said drive component.

15. The exercise machine of claim 8, wherein said engagement member is a rotatable engagement member.

16. The exercise machine of claim 8, wherein drive component further comprises means for facilitating the rotation of said engagement member at said adjustment positions.

17. An exercise machine comprising:

a support structure;

a crank having a proximal end pivotally coupled to said support structure and configured to rotate about a first pivot axis, said crank further having a plurality of adjustment apertures formed therein;

a strut pivotally mounted at a first end thereof to said crank at a position radially offset from said first pivot axis, said strut configured to travel about a radial path upon rotation of said crank;

a reciprocating foot support having (i) a proximal end rotatably coupled to said strut, and (ii) a distal end linked to said support structure, and a link having a proximal end pivotally coupled to said crank at a second axis and a distal end coupled to said strut, wherein said distal end of said link is adapted to be selectively rotated relative to said crank about said second axis while said proximal end of said link remains pivotally coupled to said crank to thereby allow selective coupling of said first end of said strut to one of at least two adjustment positions defined by said plurality of adjustment apertures to vary said radial offset position of said strut and said reciprocating foot support with respect to said first pivot axis to thereby vary said stride length.

18. The exercise machine of claim 17, wherein said strut is pivotally coupled to said crank via a link having a proximal end pivotally coupled to a distal end of said crank, said link configured to rotate about a second pivot axis positioned offset from said first pivot axis to adjust the radial offset position of said strut and said reciprocating foot support.

19. The exercise machine of claim 17, wherein said strut is configured to couple directly to said crank.

20. The exercise machine of claim 18, wherein said adjustment apertures are configured to releasably engage said strut to vary said stride length of said reciprocating foot support.

21. The exercise machine of claim 20, wherein said adjustment mechanism comprises:

a pin contained within said strut and configured to releasably and selectively engage said plurality of adjustment apertures upon rotation of said link about said second pivot axis to adjust said radial offset position and to resultantly vary said stride length of said reciprocating foot support; and biasing means configured to bias said pin within said plurality of adjustment apertures formed within said crank.

22. The exercise machine of claim 21, wherein said adjustment apertures are oriented along a common linear path.

23. The exercise machine of claim 21, wherein said adjustment apertures are oriented along a curved path.

24. The exercise machine of claim 17, wherein said crank comprises a slot formed therein, and wherein said strut is configured to releasably and slidably engage said slot, said slot slidably receiving said strut and defining said at least two adjustment positions.

25. The exercise machine of claim 17, wherein said reciprocating foot support is releasably coupled to said strut.

26. The exercise machine of claim 17, wherein said support structure, said crank, said strut, and said adjustment mechanism are each configured to form an elliptical exercise machine.

27. The exercise machine of claim 17, wherein said support structure, said crank, said strut, and said adjustment mechanism are each configured to form a rear mechanical-type elliptical exercise machine.

28. The exercise machine of claim 17, wherein said crank comprises a length to width ratio substantially equivalent to two to one in order to accommodate a plurality of said adjustment positions located about said crank along a path selected from any one of a diagonal, radial, random, and curved path.

29. An elliptical exercise machine comprising:

a support structure;

a crank having a proximal end pivotally coupled to said support structure and configured to rotate about a first pivot axis, said crank comprising a plurality of adjustment apertures formed therein, each being radially offset from said first pivot axis and each defining an adjustment position;

a link member having a proximal end and a distal end, the proximal end being pivotally mounted at a second pivot axis to a distal end of said crank, the second pivot axis being positioned offset from said first pivot axis, the distal end of said link member being configured to rotate about said second pivot axis, said distal end of said link member selectively moving between said plurality of adjustment apertures while said proximal end of said link member pivots on said crank;

a strut extending from a said distal end of said link member and configured to provide a third pivot axis that is radially offset from said first pivot axis and said second pivot axis, said strut configured to travel about a radial path upon rotation of said crank;

a reciprocating foot support having a proximal end rotatably coupled to said strut and a distal end linked to said support structure such that said strut travels about a radial path upon rotation of said crank, said reciprocating foot support configured to traverse a closed path such that said reciprocating foot support has an adjustable stride length; and a pin moveably mounted within said strut and configured to selectively engage said crank within a selected one of said adjustment apertures upon rotation of said distal end of said link member about said second pivot axis to vary the position of the third pivot axis with respect to the first pivot axis and the second pivot axis, to thereby vary said stride length of said reciprocating foot support.

30. An elliptical exercise device, comprising:

a support structure;

a crank arm pivotally mounted on said support structure, said crank arm having a first pivot axis;

a coupling assembly pivotally mounted at a first end thereof on said crank arm at a second pivot axis and selectively mounted at a second end thereof to one of a plurality of separate, discrete adjustment positions in said crank arm, wherein said second end of said coupling assembly is a free end that is adapted to be selectively moved while said first end pivots on said crank arm; and a foot support linked at a first end thereof to said support structure and at a second end thereof to said coupling assembly, such that an effective length of said crank arm is selectively varied by moving said coupling assembly from a first position on said crank arm to a second position on said crank arm.

31. The elliptical exercise device of claim 30, wherein said coupling assembly comprises:

a link which is pivotally coupled at a first end thereof to said first position on said crank arm and selectively coupled at a second end thereof to one of said plurality of separate, discrete adjustment positions in said crank arm; and a strut which is affixed on said second end of said link such that said second end of said foot support is linked to said strut.

32. The elliptical exercise device of claim 30, wherein said plurality of separate, discrete adjustment positions in said crank arm are adjustment apertures.

33. The elliptical exercise device of claim 30, wherein said support structure comprises an upright support, said upright support comprising a swing arm pivotally coupled at a first end thereof to said upright support, and wherein said foot support is linked at its first end to a second end of said swing arm.

34. An elliptical exercise device, comprising:

a support structure;

a crank pivotally mounted on said support structure;

a coupling assembly pivotally mounted at a first end thereof to a first position on said crank and selectively mounted at a second end thereof to one of a plurality of separate, discrete adjustment positions in said crank, wherein said second end is selectively moved to said one of said plurality of separate, discrete adjustment positions on said crank while said first end remains pivotally mounted to said first position on said crank; and a foot support linked at a first end thereof to said support structure and at a second end thereof to said coupling assembly, wherein a stride length of said foot support is selectively varied by moving said coupling assembly from a first adjustment position with respect to said crank to a second adjustment position with respect to said crank, wherein the crank pivots about a first pivot axis, the first end of the coupling assembly pivots about a second pivot axis, and the second end of the foot support pivots about a third pivot axis, and wherein each of the first, second, and third pivot axes are offset from each other.

35. The elliptical exercise device of claim 34, wherein said coupling assembly comprises:

a link having a first end pivotally coupled to said first position on said crank and a second end configured to rotate while said first end of said link pivots about said first position on said crank;

a strut pivotally coupled to said second end of said link, said strut configured to travel about a radial path upon rotation of said crank; and an adjustment mechanism adapted to facilitate selective coupling of said second end of said link to said one of said plurality of separate, discrete adjustment positions in said crank.

36. The elliptical exercise device of claim 35, wherein said adjustment mechanism comprises:

a pin contained within said strut and configured to releasably and selectively engage said plurality of separate, discrete adjustment positions in said crank upon rotation of said second end of said link to thereby vary said stride length of said foot support; and a means for biasing configured to bias said pin within said plurality of separate, discrete adjustment positions in said crank.

37. The elliptical exercise device of claim 34, wherein said second end of said coupling assembly is a free end that is selectively engageable with one of said plurality of separate, discrete adjustment positions in said crank.

* * * * *

UNITED STATES PATENT AND TRADEMARK OFFICE

CERTIFICATE OF CORRECTION

PATENT NO. : 7,604,573 B2
APPLICATION NO. : 11/107375
DATED : October 20, 2009
INVENTOR(S) : Dalebout et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 534 days.

Signed and Sealed this

Fifth Day of October, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,604,573 B2
APPLICATION NO. : 11/107375
DATED : October 20, 2009
INVENTOR(S) : Dalebout et al.

It is certified that error appears in the above-identified patent and that said Letters Patent is hereby corrected as shown below:

Title Page

Primary Examiner, change "Loan" to --LoAn--

Drawings

Sheet 13, replace FIG. 14 with the figure depicted herein below, wherein label "848" has been added.

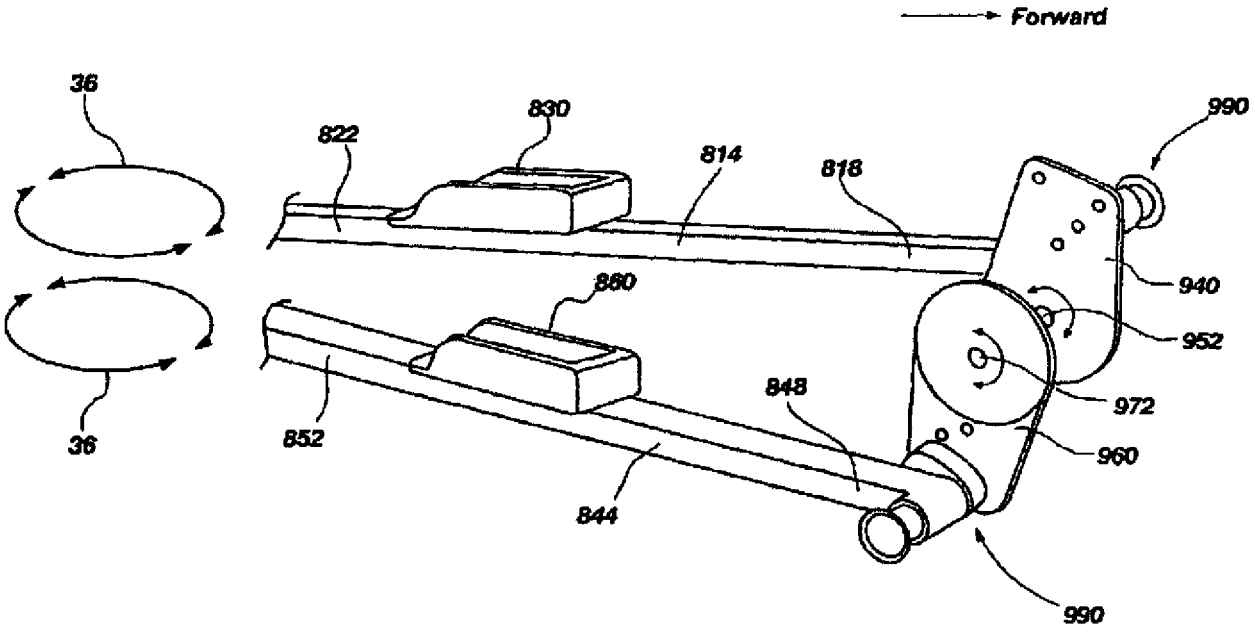

FIG. 14

Signed and Sealed this
Thirtieth Day of August, 2011

David J. Kappos

David J. Kappos
*Director of the United States Patent and Trademark Office*

Column 1
Line 64, change “front” to --from--
Line 67, change “anti” to --and--
Line 67, change “exorcise” to --exercise--

Column 5
Line 49, change “illustrated is” to --illustrates--
Line 52, change “invention” to --invention;--
Line 65, change “practice” to --to practice--

Column 6
Line 63, change “Fourth” to --Fifth--

Column 8
Line 2, change “arms” to --arms 102 and 122--
Line 16, change “elongate” to --elongated--

Column 9
Line 21, change “system or” to --system,--
Line 31, change “anti” to --and--
Line 33, change “fool” to --foot--
Line 41, change “point” to --points--
Line 43, change “root” to --foot--

Column 10
Line 5, change “22” to --44--
Line 7, change “18” to --44--
Line 23, change “a rotation” to --rotation--
Line 29, change “user” to --user to--

Column 11
Line 38, change “Flow” to --How--

Column 13
Line 4, change “are” to --and--
Line 39, change “220” to --262--
Line 43, change “slot” to --slot 264--
Line 62, change “232” to --322--

Column 14
Line 7, change “124” to --14--
Line 21, change “156” to --156-a--

Column 15
Line 54, change “FIGS. 10-A and 10-B” to --FIGS. 10A and 10B--

Column 16
Line 40, change “slidably and” to --slidably,--
Line 54, change “one” to --one of--

Column 17
Line 67, change “based” to --based on--